US007254350B2

(12) United States Patent
Kawamura et al.

(10) Patent No.: US 7,254,350 B2
(45) Date of Patent: Aug. 7, 2007

(54) IMAGE FORMING APPARATUS FEATURING A VARIABLE OSCILLATING ELECTRIC FIELD FORMED BETWEEN A DEVELOPER CARRYING MEMBER AND AN IMAGE BEARING MEMBER DURING A DEVELOPER OPERATION IN ACCORDANCE WITH A PERIPHERAL SPEED OF THE IMAGE BEARING MEMBER

(75) Inventors: Takeshi Kawamura, Shizuoka-ken (JP); Jun Suzuki, Numazu (JP); Bunro Noguchi, Mishima (JP); Masahiro Shibata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 264 days.

(21) Appl. No.: 11/060,654

(22) Filed: Feb. 18, 2005

(65) Prior Publication Data

US 2005/0191073 A1 Sep. 1, 2005

(30) Foreign Application Priority Data

Feb. 19, 2004 (JP) ..... 2004/043548

(51) Int. Cl.
*G03G 15/06* (2006.01)

(52) U.S. Cl. ..... 399/55; 399/68

(58) Field of Classification Search ..... 399/38, 399/45, 53, 55, 56, 68
See application file for complete search history.

(56) References Cited

U.S. PATENT DOCUMENTS

| | | | | |
|---|---|---|---|---|
| 4,839,698 | A * | 6/1989 | Inuzuka et al. | 399/9 |
| 5,008,712 | A * | 4/1991 | Inuzuka et al. | 399/32 |
| 5,805,951 | A | 9/1998 | Kato et al. | 399/26 |
| 5,909,603 | A | 6/1999 | Suzuki et al. | 399/13 |
| 6,560,426 | B2 | 5/2003 | Sakaizawa et al. | 399/150 |
| 6,603,935 | B2 | 8/2003 | Tsuruya et al. | 399/50 |
| 6,611,669 | B2 | 8/2003 | Suzuki et al. | 399/149 |
| 6,751,423 | B2 | 6/2004 | Sakaizawa et al. | 399/55 |
| 7,013,097 | B2 * | 3/2006 | Akizuki et al. | 399/69 |
| 2004/0005160 | A1 | 1/2004 | Kawamura et al. | 399/55 |
| 2005/0008401 | A1 | 1/2005 | Kawamura et al. | 399/265 |

FOREIGN PATENT DOCUMENTS

| | | |
|---|---|---|
| JP | 56-135849 | 10/1981 |
| JP | 59-211069 | 11/1984 |
| JP | 7-209933 | 8/1995 |
| JP | 8-328364 | 12/1996 |

* cited by examiner

*Primary Examiner*—Hoan Tran
(74) *Attorney, Agent, or Firm*—Fitzpatrick, Cella, Harper & Scinto

(57) ABSTRACT

An image forming apparatus includes an image bearing member; a developer carrying member, disposed opposed to the image bearing member, for carrying a developer, wherein an electric field is formed between the developer carrying member and the image bearing member during a developing operation using the developer carrying member, and the electric field including an oscillating portion in which the electric field is an oscillating electric field, wherein a supply electric field of the oscillating electric field which is effective to supply the developer to the image bearing member from the developer carrying member is variably controllable in accordance with a peripheral speed of the image bearing member.

30 Claims, 19 Drawing Sheets

(a)

(b)

(c)

IMAGE FORMING APPARATUS FEATURING A VARIABLE OSCILLATING ELECTRIC FIELD FORMED BETWEEN A DEVELOPER CARRYING MEMBER AND AN IMAGE BEARING MEMBER DURING A DEVELOPER OPERATION IN ACCORDANCE WITH A PERIPHERAL SPEED OF THE IMAGE BEARING MEMBER

FIELD OF THE INVENTION AND RELATED ART

The present invention relates to an image forming apparatus which develops an electrostatic image formed on an image bearing member, into a visible image with the use of an electrophotographic method or the like. In particular, it relates to an image forming apparatus which develops an electrostatic latent image by forming an oscillatory electric field between the image bearing member and a developer bearing member.

An electrophotographic image forming apparatus forms an electrostatic image on the surface of an image bearing member by uniformly charging the image bearing member with the use of a charging means, and then, exposing the surface of the uniformly charged image bearing member to a beam of light modulated with image formation data signals. This electrophotographic image is developed into a visible image by a developing means which uses developer. Then, this visible image formed of the developer is directly transferred onto recording medium, or transferred once onto an intermediary transfer member, and then, onto recording medium from the intermediary transfer member. Then, the visible image is fixed to the recording medium by a fixing apparatus, yielding thereby a permanent copy.

Reducing the recording medium conveyance speed of the fixing apparatus of an electrophotographic image forming apparatus in order to raise the level of fixation, for example, when recording medium is thick paper (paper specifically prepared for formation of high quality image, and being generally no less than 100 g/m$^2$ in basis weight), has been a common practice. However, in some situations, when the leading edge of a recording medium begins to enter the fixing apparatus, the trailing edge of the recording medium is still in the middle of the development process. Therefore, generally, when reducing the recording medium conveyance speed of the fixing apparatus, the image bearing member, the developer bearing member for supplying the image bearing member with developer, etc., are also reduced in rotational speed in accordance with the recording medium conveyance speed of the fixing apparatus (for example, Japanese Laid-open Patent Application 7-209933).

To describe in more detail the abovementioned practice, first, referring to FIG. 18, an image forming apparatus in accordance with prior art, which employs a developing method which uses nonmagnetic single-component developer, will be described regarding the general structure thereof.

An image forming apparatus 200 has an electrophotographic photosensitive member 201 (which hereinafter will be referred to simply as photosensitive drum), which is a rotatable image bearing member. A primary charging device 202 (charge roller) as a charging means uniformly charges the peripheral surface of the rotating photosensitive drum 201. The uniformly charged peripheral surface of the photosensitive drum 201 is exposed to a beam of light projected, while being modulated with image formation data inputted from an external apparatus, from an exposing apparatus 203.

As a result, an electrostatic image is formed on the peripheral surface of the photosensitive drum 201. Then, the electrostatic image on the peripheral surface of the photosensitive drum 201 is developed by a developing apparatus 210, and the toner T having triboelectrical charge which is the same in polarity as that of the voltage applied to the charge roller 2 (that is, polarity to which photosensitive drum 201 is charged), into a visible image, that is, an image formed of the toner T (which hereinafter will be referred to as toner image). The toner image on the photosensitive drum 201 is transferred by a transfer charging device 204 (transfer roller) as a transferring means onto a recording medium Q, in a transfer station M. Then, the recording medium Q is separated from the photosensitive drum 201, and conveyed to the fixing apparatus 206, in which the toner image, which has yet to be fixed, is fixed to the recording medium Q by heat and pressure, that is, turned into a permanent image. Then, the recording medium Q is discharged from the main assembly of the image forming apparatus. As for the portion of the toner T remaining on the peripheral surface of the photosensitive drum 201, that is, the portion of the toner T which was not transferred by the transfer roller 204, it is removed by the cleaning apparatus 205 as a cleaning means. Then, the photosensitive drum 201 is used for the following image formation process.

The developing apparatus 210 is supplied with developer, for example, the developer T (toner), which is negative in inherent polarity, nonmagnetic, and made up of a single component. The developer contains yellow, magenta, cyan, or black pigment. The developing apparatus 210 has a container 216, in which developer stirring members 214 are disposed. To described more concretely with reference to the drawing, there are two stirring members in the container 216: first stirring member 214A and second stirring member 214B. As the first and second stirring members 214A and 214B are rotated in the direction indicated by arrow marks in the drawing, the toner T in the container 216 is conveyed to the development roller 211 as a developer bearing member.

In the nonmagnetic single-component developing method, it is impossible to use magnetic force to supply the development roller 211 with toner. Therefore, an elastic member, for example, a roller (which hereinafter will be referred to as developer supply roller) formed of elastic foamed substance (urethane sponge or the like), is employed, which is placed in contact with the development roller 211 to supply the development roller 211 with developer and also to strip developer from the development roller 211.

The developing apparatus 210 is also provided with a regulating blade 213 as a member for regulating the amount of developer. The regulating blade 231 is placed in contact with the development roller 211 to form a thin layer of toner on the peripheral surface of the development roller 211 by regulating the amount by which the toner T is allowed to be borne on the development roller 211 to be conveyed to the development station N (in which peripheral surface of photosensitive drum 201 is virtually in contact with peripheral surface of development roller 211). The regulating blade 213 also charges the toner T.

The development roller 211 is positioned so that there is a predetermined distance (which hereinafter will be referred to as SD gap) between its peripheral surface and the peripheral surface of the photosensitive drum 201, in the development station N. At least during the development period, a predetermined development bias is applied to the development roller 211 to form an oscillatory electric field between the photosensitive drum 201 and development roller 211.

As the toner T is conveyed to the development station N by being uniformly adhered in a predetermined thickness to the peripheral surface of the development roller 211 while being given a predetermined amount of electric charge, it is made to oscillate between the development roller 211 and photosensitive drum 201 by the abovementioned oscillatory electric field. As a result, the toner T transfers from the development roller 211 onto the peripheral surface of the photosensitive drum 201, in the pattern of the electrostatic image on the peripheral surface of the photosensitive drum 201; the electrostatic image is developed into a visible image, that is, an image formed of toner. In the case of the image forming apparatus in this embodiment, the developing apparatus 210 reversely develops the electrostatic image into a toner image, that is, it transfers the toner T, the polarity of which is the same as that to which the photosensitive drum 201 is charged, onto the numerous points of the peripheral surface of the photosensitive drum 201, the potential of which have attenuated due to the exposure of the photosensitive drum 201.

The image forming apparatus 200 structured as described above is sometimes decreased in the speed at which recording medium is conveyed through its fixing apparatus 206, in order to raise the level of fixation, for example, when the recording medium Q is a sheet of thick paper (paper specifically prepared for yielding high quality image and being generally no less than 100 g/cm$^2$ in basis weight). However, reducing the recording medium conveyance speed of the fixing apparatus 206 entails additional actions for the following reason. That is, in recent years, image forming apparatuses such as the image forming apparatus 200 have been reduced in size, and therefore, in many instances, the distance between the transfer station M and fixing apparatus 206 of the image forming apparatus is shorter than the length of the recording medium Q in terms of the direction in which it is conveyed. In these situations, when the leading edge of the recording medium Q begins to enter the fixing apparatus 206, the trailing edge of the recording medium Q is still being subjected to the developing process. Therefore, the photosensitive drum 201, development roller 211, etc., are also reduced in peripheral velocity in accordance with the speed at which the recording medium Q is conveyed through the fixing apparatus 206 (this process hereinafter will be referred to as "high quality mode").

The aforementioned Japanese Laid-open Patent Application 7-209933 discloses the high quality mode, which is different in image formation conditions from the normal image formation mode. More concretely, the high quality mode is made different from the normal mode, in the amount of the electric charge given to the peripheral surface of the photosensitive drum, that is, the potential level to which the photosensitive drum is uniformly charged.

However, the prior art such as the above described suffers from the following problems.

That is, to describe the problem with reference to the image forming apparatus shown in FIG. 18, the image forming apparatus 200 employs the developing apparatus 210, which forms an oscillatory electric field to develop a latent image. Therefore, changing the rotational speed of the photosensitive drum 201 to achieve high quality (high quality mode) is likely to change image density. Therefore, sometimes, simply changing the potential level to which the peripheral surface of the photosensitive drum 201 is charged is not enough.

FIG. 19 shows the changes in density of a solid image, which occurred as the rotational speed of the photosensitive drum 201 of the above described image forming apparatus 200 was varied. As will be evident from FIG. 19, the greater the rotational speed of the photosensitive drum 201, the lower the density of the solid image; in other words, there occurred differences in image density between the high quality mode and normal mode.

Moreover, the reduction in rotational speed of the photosensitive drum 201, for example, in the abovementioned high quality mode, exacerbates the image defect called "sweep-up", which will be described next.

Referring to FIG. 20, this "sweep-up" phenomenon will be described. FIG. 20 is an enlarged schematic sectional view of the development station, in which the peripheral surface of the photosensitive drum 201 and the peripheral surface of the development roller 211 are virtually in contact with each other, as seen from the direction parallel to the axial lines of the two rollers. In the drawing, the hatched portions represent the toner T on the photosensitive drum 201 and development roller 211. The sweep-up phenomenon is the phenomenon that the toner T collects in the immediate adjacencies of the trailing edge of a given area of the photosensitive drum 201 to be covered with the toner, in terms of the moving direction of the peripheral surface of the photosensitive drum 201.

To describe in more detail with reference to FIG. 20, as AC bias is applied to form an oscillatory electric field between the photosensitive drum 201 and development roller 211, an electric field D shaped like a barrel, represented by single-dot chain lines, is generated. As a result, the toner T having adhered to the peripheral surface of the development roller 211 is made to oscillate between the photosensitive drum 201 and development roller 211, following the lines of electric force, by the electric field D. Consequently, the toner T gradually moves outward of the electric field D relative to the point S at which the distance between the photosensitive drum 201 and development roller 211 is smallest. In other words, as the AC bias is applied, the toner T in the development station N gains a certain amount of momentum that acts to move the toner T1 outward of the development station N.

Next, the portion of the image forming operation, in which an electrostatic image is formed on the peripheral surface of the photosensitive drum 201 while the photosensitive drum 201 and development roller 211 are rotated in the directions indicated by the arrow marks, respectively, that is, the portion of the image forming operation, in which the development process is actually carried out, will be described.

Referring to FIG. 20, a portion L is the portion of the electrostatic image on the peripheral surface of the photosensitive drum 201, the potential level of which is −100 V, and to which the toner T adheres to form a part of a visible image (toner image) (portion L hereinafter will be referred to as latent image portion). The portion with a potential level of −500 V (to which peripheral surface of the photosensitive drum 201 has been charged) is the portion to which the toner T does not adhered to form a part of a visible image.

As the latent image portion L enters the development station N, the toner T on the development roller 211 begins to adhere to the latent image portion L. However, as the toner T jumps (and becomes toner T1), it gains the above described momentum which acts to move the toner T1 outward of the development station N. Therefore, the toner T1 deviates upstream of the latent image L in terms of the moving direction of the peripheral surface of the photosensitive drum 201. In addition, there is an electrical field at the border between the portion with a potential level of −100 V and the portion with a potential level of −500 V, and this electrical field acts in the direction to move the toner T1 from the portion with the potential of −500 V to the portion with the potential of 100 V. With the presence of this electrical field, the toner T1, which is being moved by the movement of the peripheral surface of the photosensitive drum 201 and the above described electric field generated by the application of the development bias, is stopped at this border. As a result, the trailing end portion of the latent image portion L, in terms of the moving direction of the peripheral surface of the photosensitive drum 201, becomes greater in the amount of toner than the leading and mid portions of the latent image portion L. In other words, the toner T1 is swept up upstream in terms of the peripheral surface of the photosensitive drum 201, and builds up (build-up H), increasing the density of the trailing end portion of the latent image portion L.

Referring to FIG. 21, it was discovered that the lower the rotational speed of the photosensitive drum 201, the more likely the toner T1 is to be swept up into the build-up H. Thus, the sweep-up phenomenon is exacerbated, for example, in the abovementioned high quality mode, in which the rotational speed of the photosensitive drum 201 is less than that in the normal mode (method for measuring value of build-up H will be described later).

Further, varying the difference in peripheral velocity between the photosensitive drum 201 and development roller 211 results in variation in image density, and sometimes exacerbates the sweep-up phenomenon.

The Japanese Laid-open Patent Application 59-211069 discloses the concept of changing the frequency of the AC voltage (bias) applied between the photosensitive drum and developer bearing member, in accordance with the image formation speed. Further, Japanese Laid-open Patent Application 56-135849 discloses the concept of changing the frequency of the alternating electric field created in the gap between the static electricity retaining member and developer bearing member, in accordance with the changes in the moving speed of the peripheral surface of the static electricity retaining member, more specifically, reducing the frequency as the moving speed is reduced, and increasing the frequency as the moving speed is increased. However, all that is disclosed in these applications regarding the prior arts is to change the frequency of the alternating voltage (bias) in accordance with the image formation speed. In other words, they do not disclose any artistic concept of changing the electric field, on the side from which developer is made to jump, that is, the force which causes developer to move onto the image bearing member, in accordance with the moving speed of the peripheral surface of the image bearing member, as will be described later.

SUMMARY OF THE INVENTION

The primary object of the present invention is to provide an image forming apparatus capable of consistently forming high quality images.

Another object of the present invention is to provide an image forming apparatus which does not change in image density even if its image bearing member or developer bearing member is changed in peripheral velocity.

Another object of the present invention is to provide an image forming apparatus which is not exacerbated in sweep-up phenomenon even when its image bearing member or developer bearing member is changed in peripheral velocity.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatuses in accordance with the present invention will be described in detail with reference to the appended drawings.

Embodiment 1

[General Structure and Operation of Image Forming Apparatus]

Figure 1:
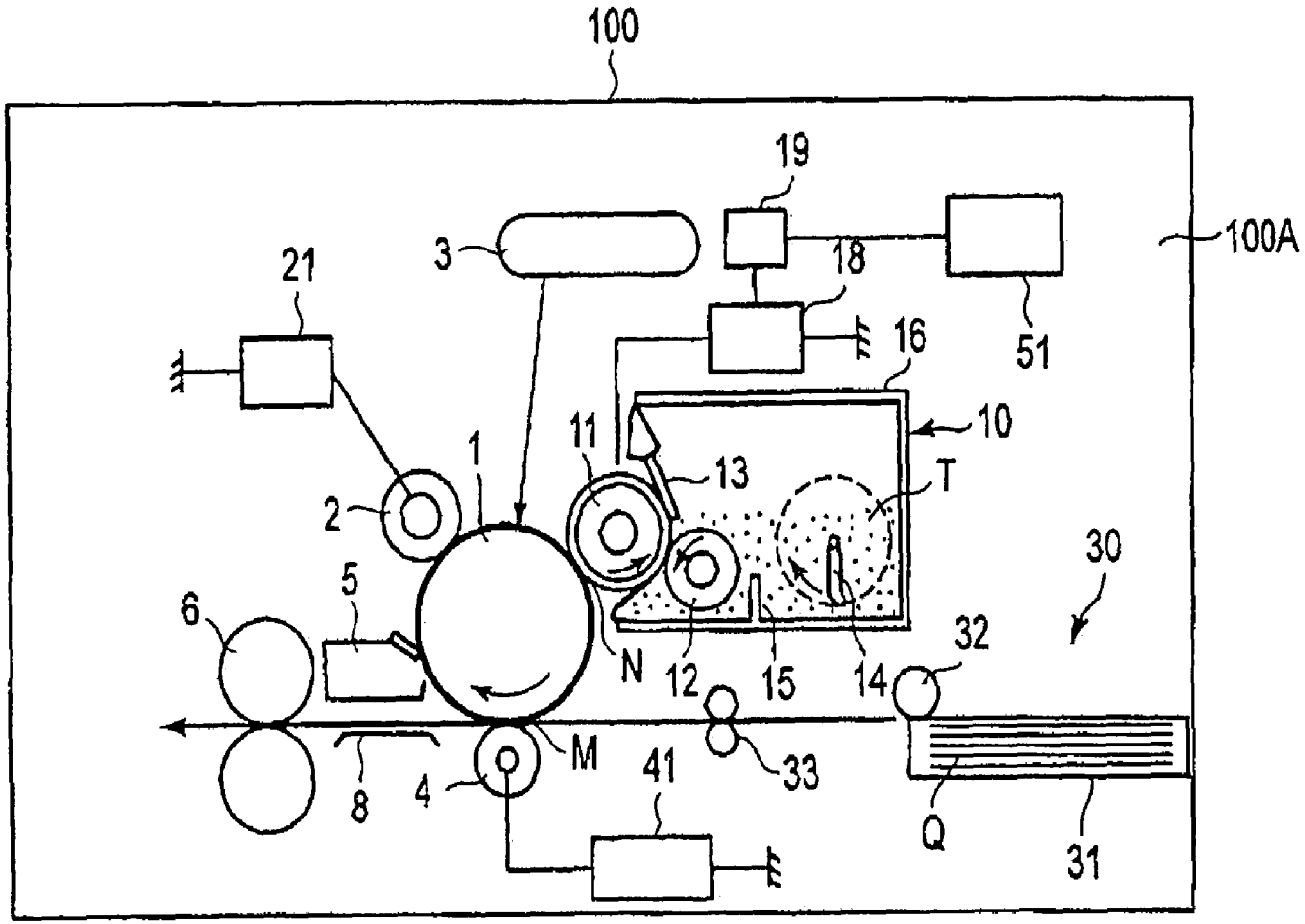
FIG. 1 is a schematic drawing of the image forming apparatus in the first embodiment of the present invention, showing the general structure thereof.

First, referring to FIG. 1, the general structure and operation of the image forming apparatus in the first embodiment of the present invention will be described. The image forming apparatus 100 in this embodiment is a laser beam printer capable of forming a full-color image, based on four color components, on recording medium such as recording paper, OHP sheet, fabric, etc., with the use of one of the electrophotographic image formation methods, in response to the image formation signals from a host such as a personal computer connected to the main assembly 100A of the image forming apparatus 100, or an external apparatus such as an original reading apparatus connected to the main assembly 100A and capable of optically reading an original and converting the obtained information about the original into electrical signals.

The image forming apparatus 100 has the rotatable photosensitive drum 1 as an image bearing member. The primary charging device 2 (charge roller) as a charging means uniformly charges the peripheral surface of the rotating photosensitive drum 1. To the charge roller 2, a predetermined charge bias is applied from a charge bias application power source 21 as a voltage applying means so that the peripheral surface of the photosensitive drum 1 is charged to a predetermined basis potential level (dark potential level $V_D$). The uniformly charged portion of the peripheral surface of the photosensitive drum 1 is exposed to a beam of light projected, while being modulated with the image formation data inputted from the external apparatus, from an exposing apparatus 3 (which in this embodiment is laser scanner). As a result, an electrostatic latent image is formed on the peripheral surface of the photosensitive drum 1.

Next, the electrostatic latent image on the peripheral surface of the photosensitive drum 1 is developed by the developing apparatus 10 and the toner T, in the developer, having triboelectric charge which is the same in polarity as the voltage applied to the charge roller 2, into a visible image, that is, an image formed of toner (which hereinafter will be referred to as toner image). The operation of the developing apparatus 10 will be described later in more detail.

Meanwhile, a recording medium Q is conveyed, in synchronism with the progression of the formation of the toner image on the peripheral surface of the photosensitive drum 1, from a recording feeding station 30 to a transfer station M where a transfer charging device 4 (transfer roller) as a transferring means opposes the photosensitive drum 1. More specifically, a plurality of recording mediums Q are stored in a cassette 31 as a recording medium storage portion. The recording medium Q is fed by a feed roller 32 as a recording medium supplying means into the main assembly 100A, and is conveyed by a pair of registration rollers 33 so that the image receiving portion of the recording medium Q arrives at the transfer station M in synchronism with the arrival of the toner image at the transfer station M.

The toner image formed on the peripheral surface of the photosensitive drum 1 through the above described process is transferred onto the recording medium Q by the transfer charging device 4 (transfer roller) as a transferring means. To the transfer roller 4, transfer bias, the polarity of which is opposite to the normal polarity (which in this embodiment is negative) to which the toner T is charged, is applied from a transfer bias power source 41 as a voltage applying means.

Thereafter, the recording medium Q is separated from the photosensitive drum 1, and is conveyed by a recording medium conveying means 8 to a fixing apparatus 6, in which the toner image on the recording medium Q, which has yet to be fixed, is fixed to the recording medium Q, being thereby turned into a permanent image. Then, the recording medium Q is discharged from the apparatus main assembly 100A.

The portion of the toner T remaining on the peripheral surface of the photosensitive drum 201, that is, the portion of the toner T which was not transferred by the transfer charging device 204, is removed by the cleaning apparatus 205 as a cleaning means having a cleaning blade or the like. Then, the photosensitive drum 1 is used for the following image formation process.

Figure 2:
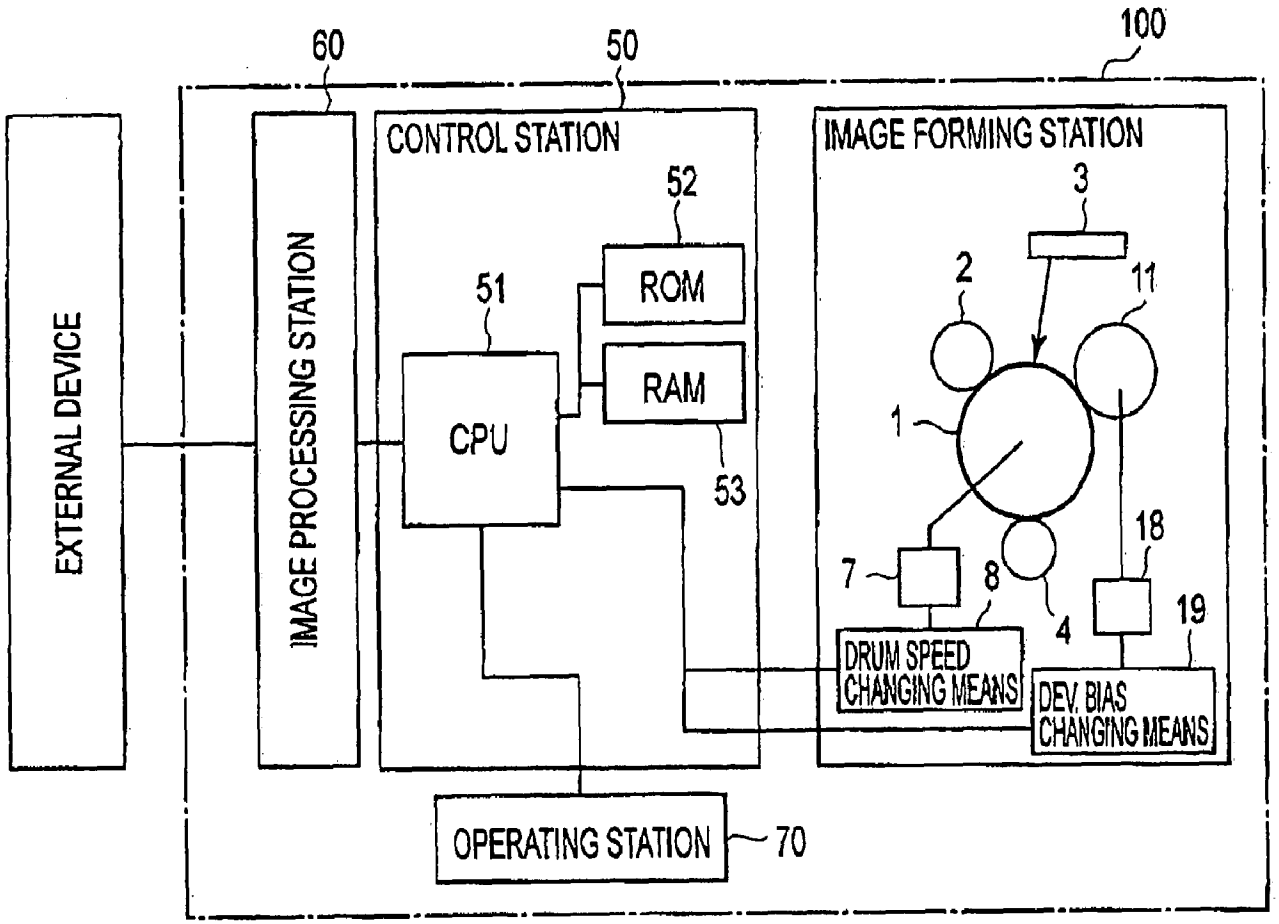
FIG. 2 is a block diagram of the control of the image forming apparatus in the first embodiment of the present invention.

Referring to FIG. 2, in this embodiment, a photosensitive drum speed varying means 8 is connected to power source 7 of the photosensitive drum driving portion. The photosensitive drum speed varying means 8 is a driving circuit enabled to vary the rotational speed of the photosensitive drum 1 in accordance with the type of the recording medium Q, or external data. Further, to the development bias applying means 18 as a voltage applying means for applying voltage to the development roller 11 of the developing apparatus 10, a development bias switching means 19 is connected, which is a driving circuit enabled to vary the development bias. The development bias switching means 19 will be described later in detail.

[Developing Apparatus]

Next, the developing apparatus 10 will be described in more detail.

The base structure of the developing apparatus 10 in this embodiment is the same as that of the image forming apparatus described before with reference to FIG. 18. In other words, the developing apparatus 10 in this embodiment employs the nonmagnetic single-component, noncontact, developing method. It comprises: a container 16 (developing apparatus housing); the development roller 11 as a developer bearing member; a developer supply roller 12 as a developer supplying member; a regulating blade 13 as a regulating member for regulating the amount by which developer is borne on the peripheral surface of the development roller 11; single-component developer (toner) T which is dielectric and nonmagnetic; and a developer stirring member (stuffing member) 14 in the form of a piece of plate.

The container 16 is provided with a hole, which faces the photosensitive drum 11, extending from one end of the photosensitive drum 1 to the other, in terms of the lengthwise direction of the photosensitive drum 1. The development roller 11 is rotatably disposed in the container 11, being partially exposed from the container 11, through the above-mentioned hole. In this embodiment, the development roller 11 is rotated in the direction indicated by an arrow mark in the drawing, that is, such a direction that makes the moving direction of the peripheral surface of the development roller 11 in the development station N the same as that of the photosensitive drum 1.

In this embodiment, the toner T is negatively charged. It contains yellow, magenta, cyan, or black pigment. It is a negatively chargeable, nonmagnetic, single-component developer (toner). As the stirring member 4 is rotated in the direction indicated by an arrow mark in the drawing, the toner T in the container 16 is conveyed to the development roller 11 by the stirring member 4.

The developer supply roller 12 (developer supplying-stripping roller) is disposed in contact with the development roller 11, and is rotated in such a direction that makes the movement of the peripheral surface of the developer supply roller 12, in the contact area (nip) between the developer supply roller 12 and development roller 11, opposite to that of the development roller 11 in the contact area. As the developer supply roller 12 is rotated, the development roller 11 is supplied with the toner T. The development supply roller 12 is also given the function of stripping from the peripheral surface of the development roller 11, the toner which was not transferred onto the photosensitive drum 1 while it was moved through the contact area between the photosensitive drum 1 and development roller 11.

Figure 18:
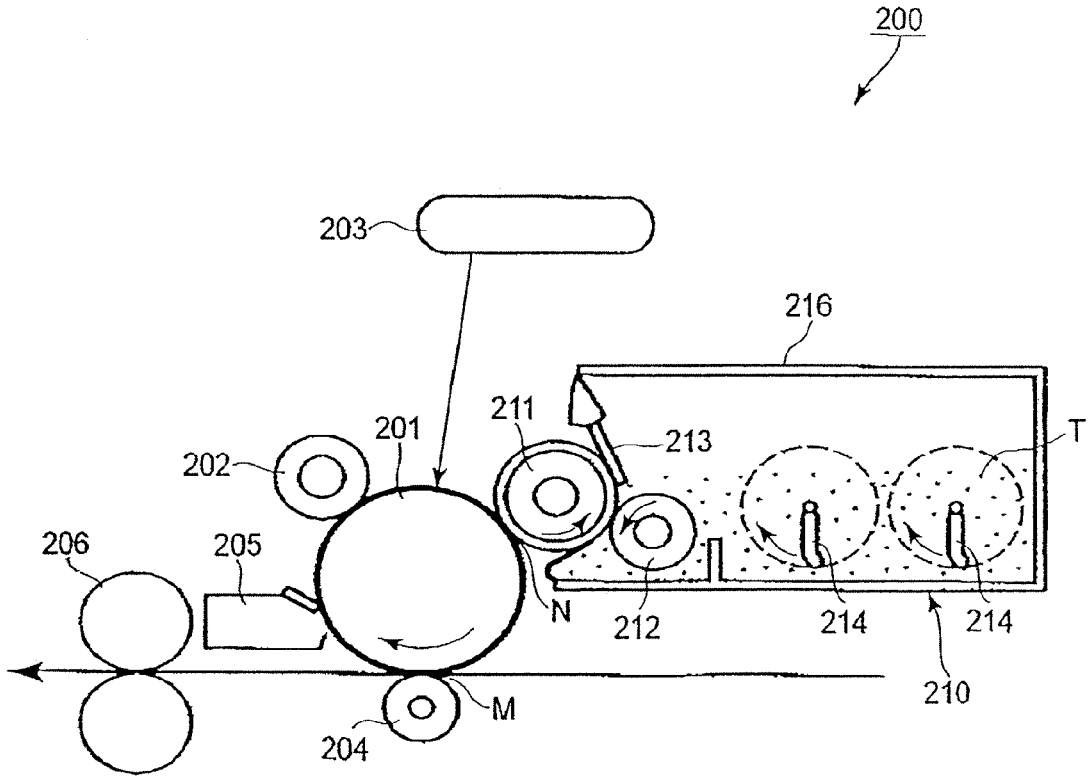
FIG.18 PRIOR ART
FIG. 18 is a schematic drawing of the essential portion of another example of an image forming apparatus in accordance with the prior art, showing the general structure thereof.
Figure 19:
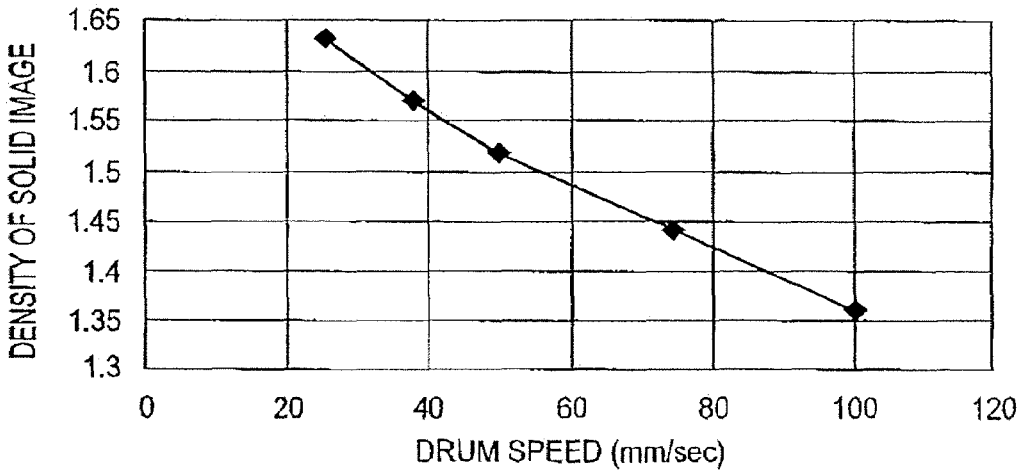
FIG.19 PRIOR ART
FIG. 19 is a graph for describing the changes in image density attributable to the changes in the rotational speed of the photosensitive drum.
Figure 20:
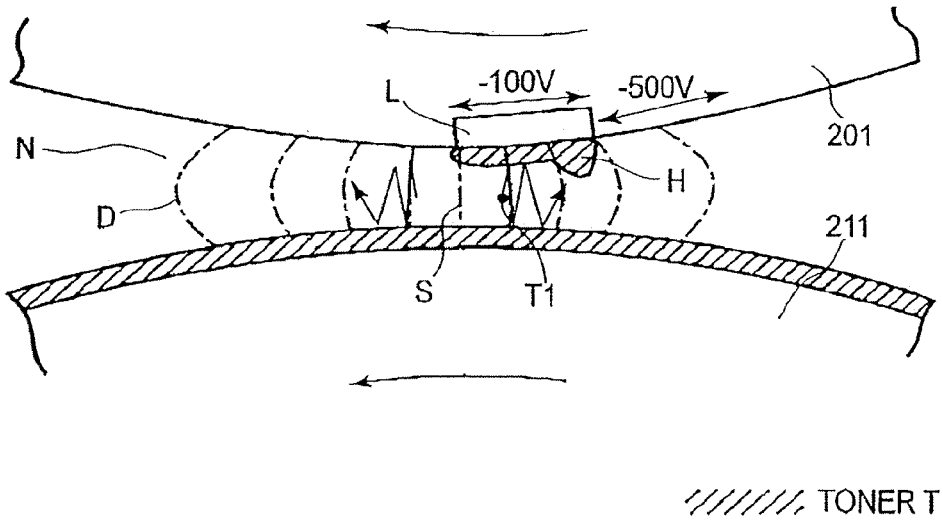
FIG.20 PRIOR ART
FIG. 20 is a schematic drawing for describing the sweep-up phenomenon.
Figure 21:
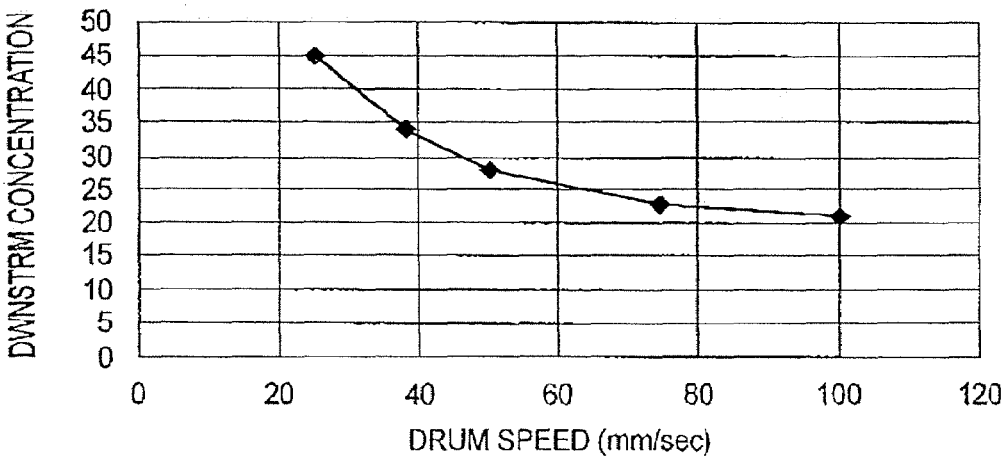
FIG.21 PRIOR ART
FIG. 21 is a graph for describing the changes in the numerical value of the sweep-up phenomenon attributable to the changes in the rotational speed of the photosensitive drum.

There is disposed a partitioning plate 15 in the container 16. The partitioning plate 15 has been optimized in height so that the toner T is consistently supplied at a predetermined rate by the stirring member 14 to the adjacencies of the developer supply roller 12 disposed next to the development roller 11. The container 16 may be provided with two (as shown in FIG. 18) or more stirring members 14. In other words, as long as the toner T is conveyed from the corners of the container 16 to the adjacencies of the development roller 11 (or developer supply roller 12), the number of the stirring members 14 does not need to be limited; it may be determined in accordance with the structure of the developing apparatus 10. Further, the stirring member 14 may be in the form of a piece of plate different in shape from the one in this embodiment, or in the form of a screw.

The aforementioned regulating blade 13 as a developer amount regulating member is placed in contact with the development roller 11. Not only does it form a thin layer of toner T on the peripheral surface of the development roller 11, and regulate the amount by which toner is conveyed to the development station N, but also, charges the toner T. The amount by which the toner T is conveyed to the development station N can be controlled by the contact pressure, contact length, etc., between the development roller 11 and the regulating blade 13. The regulating blade 13 comprises a piece of roughly several hundreds of micron meter thick plate of metal such as phosphor bronze, stainless steel, or the like, and a regulating portion formed of resin and bonded or welded to the metallic plate. The regulatory conditions of the regulating blade 13 can be controlled by controlling the material and thickness of the metallic plate, the apparent entry of the regulating blade 13 into the development roller 11, and the angle of the regulating blade 13.

The development roller 11 is disposed so that there is a predetermined amount of gap (SD gap) between the peripheral surface of the development roller 11 and photosensitive drum 1, in the development station N. At least during the development process, an oscillatory electric field is formed between the photosensitive drum 1 and development roller 11 by applying a predetermined development bias to the development roller 11. This process will be described later in more detail.

As for the development process carried out in the developing apparatus 10 structured as described above, as the toner T is conveyed to the development station N by being uniformly adhered in a predetermined thickness to the peripheral surface of the development roller 11 while being given a predetermined amount of electric charge, it is made to shuttle between the development roller 11 and photosensitive drum 1 by the development bias applied from a development bias power source 18 as a voltage applying means. As a result, the toner T transfers from the development roller 11 to the peripheral surface of the photosensitive drum 1, in the pattern of the electrostatic image on the peripheral surface of the photosensitive drum 1; the electrostatic image is developed into a visible image, that is, an image formed of toner.

Figure 3:
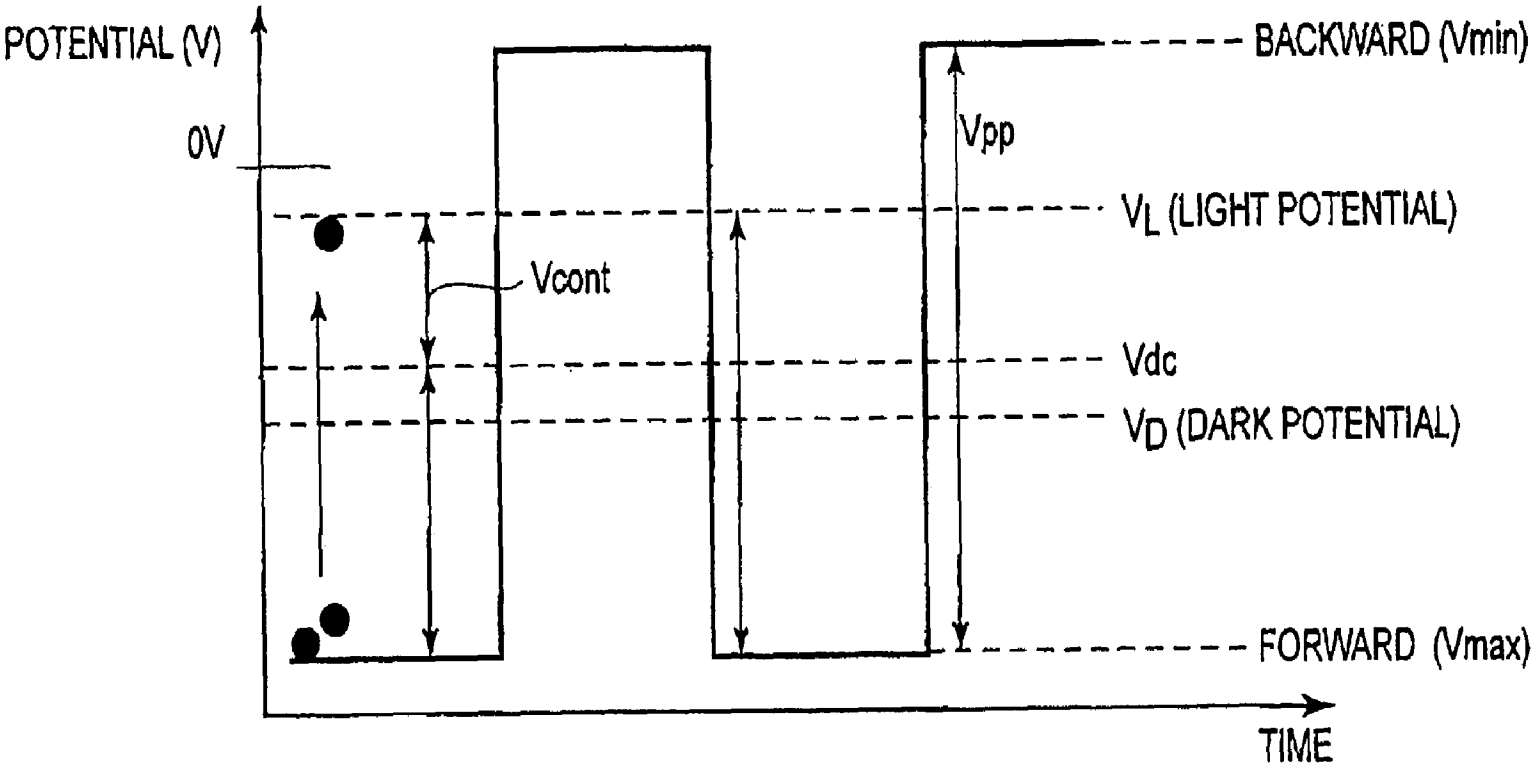
FIG. 3 is a graph depicting the oscillatory electric field formed between the photosensitive drum and development roller.

To describe in more detail with reference to FIG. 3, in this embodiment, the developing apparatus 10 employs a nonmagnetic, noncontact, single-component developing method (jumping developing method). Prior to the development, the photosensitive drum 1 is uniformly charged by the charge roller 2 to a predetermined polarity (which in this embodiment is negative) and a predetermined potential level (dark potential level $V_D$). Then, the uniformly charged photosensitive drum 1 is exposed by an exposing apparatus 3. As a result, the exposed portions of the photosensitive drum 1 reduce in potential level to the predetermined level (light potential level $V_L$); the exposed portions turn into the image portions of the electrostatic image. There is the predetermined amount of gap (SD gap) between the photosensitive drum 1 and development roller 11, and the electrostatic image is developed by the application of the development bias, which is a combination of AC voltage and DC voltage, to the development roller 11. The gap between the photosensitive drum 1 and development roller 11 is greater than the thickness of the toner layer on the development roller 11. Therefore, as the development bias is applied, the toner jumps from the development roller 11 to the photosensitive drum 1. More specifically, to the development roller 11, the DC component $V_{dc}$ which is greater in potential than the toner T (normal polarity of which in this embodiment is negative), and smaller in potential than the dark potential level $V_D$, in terms of the normal polarity direction of the toner T (negative direction, in this embodiment), is applied in combination with the AC component. The difference between this DC component $V_{dc}$ and potential level $V_L$ of the image portion of the electrostatic image is the development contrast $V_{cont}$. Regarding the electric field formed between the photosensitive drum 1 and development roller 11 during the development process, the toner T is induced by the voltage $V_{max}$, or the toner repelling voltage, to jump from the development roller 11 to the photosensitive drum 1, and is induced by the voltage $V_{min}$, or the toner attracting voltage, to jump from the photosensitive drum 1 to development roller 11. In other words, the toner T is made to shuttle between the development roller 11 and photosensitive drum 1, and as it is made to shuttle, it adheres to the image portions (portions with light potential level $V_L$) of the electrostatic image. Thus, in order to form the alternating electric field between the dark potential level portion of the photosensitive drum 1 and the development roller 11, and between the light potential level portion of the photosensitive drum 1 and the development roller 11, the $V_{max}$ is set so that its value is greater than that of the dark potential level $V_D$, and the $V_{min}$ is set so that its value is smaller than that of the $V_L$, as shown in FIG. 3. In this embodiment, the oscillatory electric field between the photosensitive drum 1 and development roller 11 is the alternating electric field between the two.

In this embodiment, the photosensitive drum 1 comprises: a piece of plain aluminum tube with a diameter of 30 mm; and a layer of photosensitive substance (which in this embodiment is OPC) coated on the peripheral surface of the aluminum tube. As for the development roller 11, it is a piece of plain aluminum tube with a diameter of 16 mm, the surface of which is spray coated with a phenol resin solution in which carbon and graphite are dispersed. The end portions of the development roller 11, in terms of the lengthwise direction (direction parallel to its axial line) are fitted with a pair of rings (unshown), one for one, which are placed in contact with the peripheral surface of the photosensitive drum 1 to maintain the SC gap between the development roller 11 and photosensitive drum 1. In this embodiment, the SC gap is set to 300 μm. As for the developer supply roller 12, it comprises: a metallic core with a diameter of 5 mm; and a 4.5 mm thick layer of urethane foam covering the peripheral surface of the metallic core. As for the thin metallic plate of the regulating blade 13, it is formed of 0.1 mm thick plate of phosphor bronze.

FIG. 2 is a block diagram showing the control system of the image forming apparatus 100 in this embodiment. The image forming apparatus 100 is provided with a control portion 50, which comprises: a controlling means (CPU) 51 as the central element for controlling the image forming apparatus 100; a ROM 52 as a storage means; and a RAM 53 as a storage means. The control portion 50 controls the operational sequence of the image forming apparatus 100 with the use of programs and data stored in the ROM 52 and RAM 52; it coordinately controls the various portions of the electrophotographic image forming apparatus 100, for example, the charge roller 2, exposing apparatus 3, developing apparatus 10, transfer roller 4, fixing apparatus 6, recording medium supplying portion 30, etc.

In this embodiment, the photosensitive drum speed varying means 8 and development bias varying means 19 vary the rotational speed of the photosensitive drum 1 and development bias, respectively, in response to the signals which the controlling means 51 (CPU) of the controlling portion 50 generates based on the programs and data stored in the ROM 52 and RAM 53. This subject will be described later in more detail.

To the control portion 50, an image processing portion 60 is connected, which receives video signals from a host device, such as personal computer, communicatively connected to the main assembly 100A of the image forming apparatus 100, or an original reading apparatus, and also, transmits to the control portion 50 signals related to image formation. The control portion 50 controls the operations of various portions of the image forming apparatus 100, in response to these image formation signals. The image forming apparatus main assembly 100A is provided with a control panel 70 having a display portion, an inputting means such as a keyboard, etc., and connected to the CPU 51 of the control portion 50.

[Development Bias Voltage]

Next, the switching of the development bias voltage, in accordance with the rotational speed, that is, peripheral velocity, of the photosensitive drum 1, which characterizes this embodiment, will be described.

In this embodiment, the normal rotational speed of the image forming apparatus 100 is 50 mm/sec. The image forming apparatus 100 is provided with the photosensitive drum speed varying means 8, which is capable of switching the rotational speed of the photosensitive drum 1 among the 50 mm/sec (which is normal speed), 25 mm/sec, and 100 mm/sec.

Further, the image forming apparatus 100 is provided with the development bias varying means 19, which is capable of varying the development bias applied to the development roller 11, in accordance with the rotational speed of the photosensitive drum 1. On the other hand, in this embodiment, the development roller 11 is made to always rotate at a peripheral velocity equal to 150% of the peripheral velocity of the photosensitive drum 1 regardless of the changes in the peripheral velocity of the photosensitive drum 1. Therefore, if the peripheral velocity of the photosensitive drum 1 is doubled, the peripheral velocity of the development roller 11 also doubles.

In order to form the body of toner on the peripheral surface of the development roller 11 into a thin uniform layer of toner, the regulating blade 13 is set in contact with the development roller 11 so that it is tilted counter to the rotational direction of the development roller 11, that is, the free edge of the development blade 13 is positioned upstream of the base portion of the development blade 13, and also, so that the linear contact pressure of 30 g/cm is maintained between the development blade 13 and development roller 11.

In order to prevent the abovementioned changes in the rotational speed of the photosensitive drum 1 from changing the image forming apparatus 100 in image density, and also, to prevent the sweep-up phenomenon from being exacerbated, not only is the image forming apparatus 100 structured as described above, but also, is provided with the following structural arrangement.

More specifically, the image forming apparatus 100 is structured so that the oscillatory electric field formed between the photosensitive drum 1 and development roller 11 is switched, on the repelling side, during the development process; the force which acts in the direction to cause the toner T to jump from the development roller 11 to the photosensitive drum 1, is switched in accordance with the rotational speed, that is, peripheral velocity, of the photosensitive drum 1. The voltage level of the oscillatory electric field, on the side from which the toner T is caused to jump, that is, the force which acts in the direction to cause the toner T to transfer onto the photosensitive drum 1, can be changed by changing at least one factor among the peak-to-peak voltage $V_{pp}$ of the AC voltage as a part of the development bias applied to the development roller 11, DC voltage $V_{dc}$ as another part of the development bias applied to the development roller 11 in combination with the AC bias; and ratio of the duration (which hereinafter will be referred to as development duty) of the toner repelling side (side from which the toner T is made to jump) of the AC bias rectangular in waveform, and waveform of the AC voltage. Further, it is effective to change the frequency f. Changing the DC voltage $V_{dc}$ and/or development duty is convenient, because the DC voltage $V_{dc}$ and development duty can be changed with the use of a relatively simple circuit.

Generally, increasing the peak-to-peak voltage $V_{pp}$ of the AC voltage as a part of the development bias, increasing the $V_{dc}$ of the DC voltage as another part of the development bias in the same direction as the direction of the normal polarity of the toner T, and/or increasing the development duty, results in the increase in the voltage level of the oscillatory electric field, on the side from which the toner T is caused to jump, that is, the increase in the force which acts to move the toner T onto the photosensitive drum 1. As for the waveform of the AC voltage, generally, the force which acts in the direction to move the toner T onto the photosensitive drum 1 is greater when the waveform of the AC voltage is rectangular than when it is sinusoidal. Further, increasing the frequency of the AC voltage increases the force which acts in the direction to move the toner T onto the photosensitive drum 1. Incidentally, all that is necessary when using some, or all, of the above described methods of changing the peak-to-peak voltage $V_{pp}$ of the AC voltage, DC bias voltage $V_{dc}$, development duty, waveform of the AC voltage, and frequency f, is to adjust in magnitude the force which is generated in the direction to move the toner T onto the photosensitive drum 1, by the optional combination of these methods, in accordance with the rotational speed of the photosensitive drum 1. In other words, it is permissible that the magnitude of the force generated by the entirety of the above mentioned methods is not the same as the magnitude of the force generated by one of the methods. For example, that the development duty is 40% means that the duration of the portion of the voltage, on the $V_{max}$ side, that is, the portion of the voltage which causes the toner T to jump from the development roller 11, relative to the duration of a single cycle of the development bias (voltage) is 40%. This means that the duration of the portion of the voltage, on the $V_{min}$ side, that is, the portion of the voltage that causes the toner T to be attracted to the development roller 11, is 60%.

Table 1 given below shows the relationship between the rotational speed of the photosensitive drum 1 and the values to which the development bias is set, in this embodiment. The dark potential level on the photosensitive drum 1 of the image forming apparatus 100 in this first embodiment is −500 V, whereas the light potential level is −100 V.

TABLE 1

| DRUM DUTY (mm/sec) | BIAS | f | Vpp (Hz) | Vdc (V) | DEV. (V) | WAVEFORM SPEED (%) |
|---|---|---|---|---|---|---|
| 50 | (1) | 3000 | 2000 | −250 | 50 | RECT. |
| 25 | (2) | 3000 | 1900 | −200 | 50 | SIN |
| 100 | (3) | 3500 | 2200 | −300 | 45 | RECT. |

In order to confirm the effects of the present invention, the image forming apparatus 100 in this embodiment, the development bias of which was changed in accordance with Table 1 given above, was compared to a comparative image forming apparatus (first comparative image forming apparatus), which was the same in structure as the image forming apparatus 100 in this embodiment, but, was different in that the development bias was not changed even when the rotational speed of the photosensitive drum 1 was changed.

The development bias of the first comparative image forming apparatus was the same as the bias condition (1) in Table 1. In other words, it was 3,000 Hz in frequency, 2,000 V in peak-to-peak voltage $V_{pp}$ of the AC voltage, −250 V in the DC voltage $V_{dc}$, 50% in development duty, and rectangular in waveform.

Figure 4:
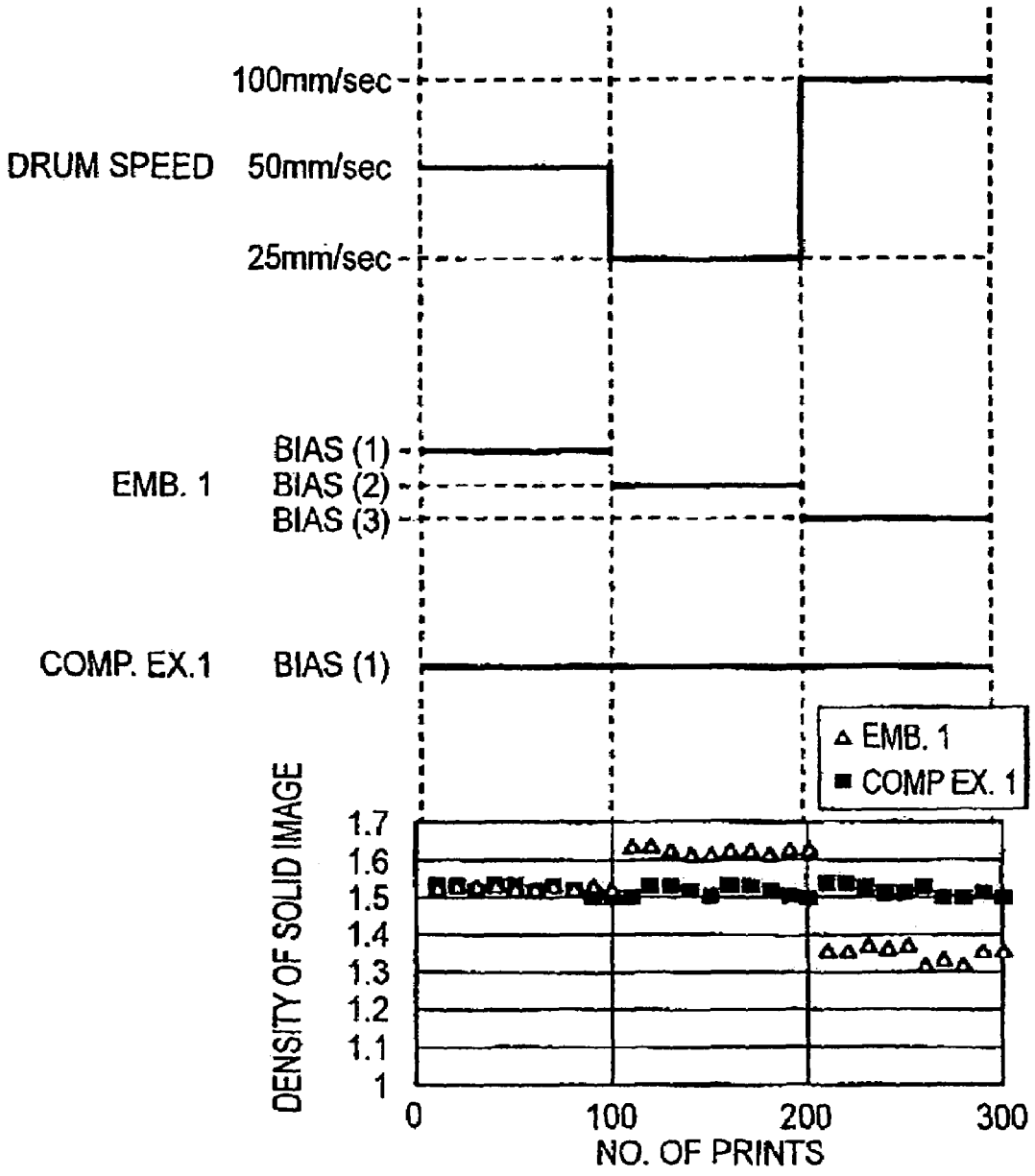
FIG. 4 is a graph showing the effects of the present invention.

In the comparative test, 100 copies were printed with the photosensitive drum 1 rotated at 50 mm/sec, and then, 100 copies were printed with the photosensitive drum 1 rotated at 25 mm/sec. Finally, 100 copies were printed with the photosensitive drum 1 rotated at 100 mm/sec. Thereafter, the density of the solidly toner covered portion of the printed image was measured with the use of a commercially available reflection densitometer. FIG. 4 shows the timing chart, and the relationship between the density (average density of every 10 copies) of the solidly toner covered portion of the image and the cumulative number of printed copies.

As will be evident from FIG. 4, in the case of the first comparative image forming apparatus, as the rotational speed of the photosensitive drum 1 was varied, the solid image density (maximum image density) also changed, whereas in the case of the image forming apparatus in this embodiment, the solid image density remained stable even when the rotational speed of the photosensitive drum 1 was varied.

The reason for the abovementioned results is thought to be as follows.

Figure 5:
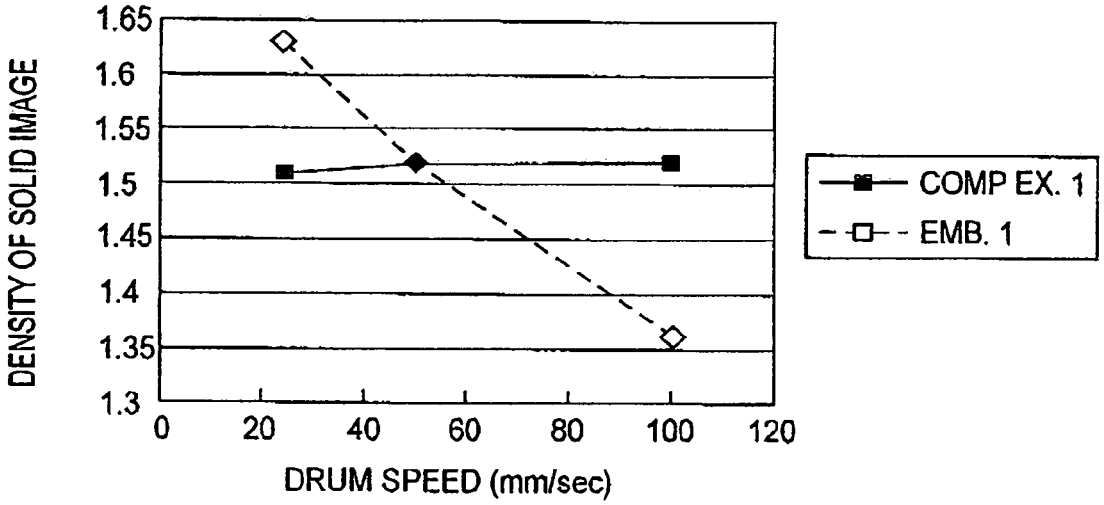
FIG. 5 is a graph showing the effects of the present invention.

FIG. 5 shows the relationship between the rotational speed of the photosensitive drum 1 and solid image density (maximum image density), in the comparative test of the image forming apparatus in this embodiment, and the first comparative image forming apparatus. In the drawing, the solid line represents the test result for the apparatus in this embodiment, and the broken line represents the test result for the comparative apparatus.

As shown in FIG. 5, in the case of the comparative apparatus, as the rotational speed of the photosensitive drum 1 was increased, the solid image density decreased.

In comparison, in the case of the apparatus in this embodiment, even when the photosensitive drum speed was varied, the solid image density remained steady. This result is thought to be attributable to the fact that the length of time the toner T contributes to development was affected by the rotational speed of the photosensitive drum 1. That is, when the development bias was kept at the same level regardless of the rotational speed of the photosensitive drum 1 as it was in the case of the first comparative apparatus, as the rotational speed of the photosensitive drum 1 was reduced, the length of time available for development increased, resulting in the increase in density, whereas as the rotational speed of the photosensitive drum 1 was increased, the length of time available for development decreased, resulting in the decrease in density.

In this embodiment, as the rotational speed of the photosensitive drum 1 was decreased, the force which acted in the direction to move the toner T toward the photosensitive drum 1 was reduced, whereas as the rotational speed of the photosensitive drum 1 was increased, the force which acted in the direction to move the toner T toward the photosensitive drum 1 was increased. With the employment of this control, the image density remained constant in spite of the changes in the photosensitive drum speed.

Also in this embodiment, when the rotational speed of the photosensitive drum 1 was reduced, the developmental force was reduced by adjusting the peak-to-peak voltage $V_{pp}$ of the AC voltage, DC bias value $V_{dc}$, and AC waveform, whereas when the rotational speed of the photosensitive drum 1 was increased, the developmental force was increased by adjusting the frequency f, peak-to-peak voltage $V_{pp}$ of the AC voltage, DC bias value $V_{dc}$, and development duty. However, the effect of the present invention can also be realized by adjusting the developmental force of the toner by adjusting any, or a combination, of the parameters which affect the development bias, in response to the changes in the speed of the photosensitive drum 1. In other words, the selection of the parameters which affect the development bias, and the selection of the values therefor, are optional.

For example, it is possible to control the image forming apparatus so that in the normal image formation mode, that is, the typical mode, for example, when forming an image on a sheet of ordinary paper as the recording medium Q, the rotational speed of the photosensitive drum 1 is set to 50 mm/sec; in the high quality mode, that is, when forming an image on a sheet of cardboard or the like (paper specifically prepared for high quality image, and generally, no less than 100 g/cm$^2$ in basis weight), the rotational speed of the photosensitive drum 1 is set to 25 mm/sec; and in the high speed mode, that is, the mode in which printing speed is a priority over image quality, and an image is formed on a sheet of ordinary paper as recording medium Q with a basis weight of 75 g/cm$^2$, the rotational speed of the photosensitive drum 1 is set to 100 mm/sec. Incidentally, this example is not intended to limit the scope of the present invention. The switching among these image formation modes is done by the CPU of the control portion 50, in response to the input from the control panel 70 of the image forming apparatus main assembly 100A, or the inputting means, such as a personal computer, communicatively connected to the apparatus main assembly 100A. The CPU 51 controls the operation of each portion of the image forming apparatus 100 in accordance with the operational conditions for each image formation mode. However, the image forming apparatus 100 may be provided with a sensor for detecting the thickness of the recording medium Q, a sensor for detecting the transmittance of the recording medium Q, etc., in order to enable the CPU 51 of the control portion 50 to determine the type (thickness) of the recording medium Q in response to the inputs from these sensors and automatically select the optimum image formation mode based on the determined type of the recording medium Q. In this case, in response to the signal generated by the CPU 51 in response to the image formation mode selected as described above, the photosensitive drum speed varying means 8 automatically switches the rotational speed of the photosensitive drum 1, and the development bias varying means 19 automatically switches the development bias in response to the new value to which the rotational speed of the photosensitive drum 1 has just been automatically switched. Incidentally, as has already been stated, when the recording medium is cardboard, it is desired that the fixation speed is rendered slower compared to the fixation speed for ordinary paper, in order to keep the level of the fixation of the fixing apparatus at a satisfactory level, and therefore, the photosensitive drum 1 is also reduced in peripheral velocity.

As described above, this embodiment prevents the image forming apparatus from changing in image density even when the rotation speed of the photosensitive drum 1 is varied, enabling thereby the image forming apparatus to always form high quality images.

Embodiment 2

Next, another embodiment, or the second embodiment, of the present invention will be described. The basic structure and operation of the image forming apparatus in this embodiment are virtually the same as those in the first embodiment. Thus, the components of the image forming apparatus in this embodiment, which are virtually identical or equivalent in structure and function to those in the first embodiment, are given the same referential symbols as those given for the description of the first embodiment, and will not be described in detail.

Figure 6:
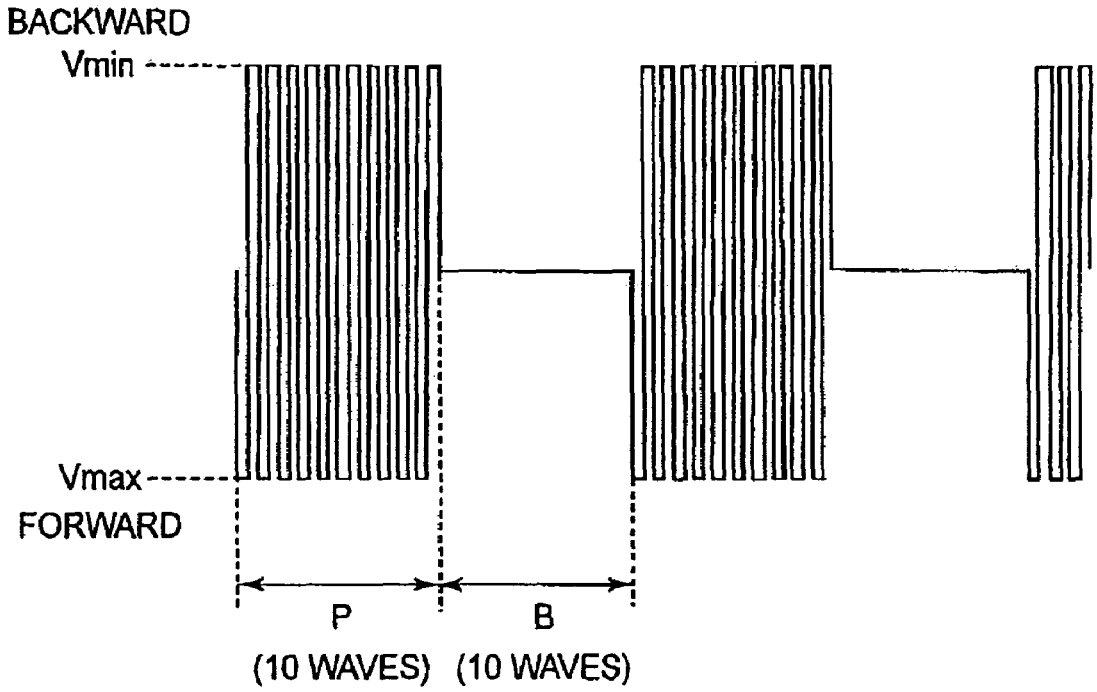
FIG. 6 is a schematic drawing depicting the blank pulse bias.

Referring to FIG. 6, also in this embodiment, a combination of AC and DC voltages is used as development bias. In this embodiment, however, AC and DC voltages are combined in such a manner that the development bias is provided with portions in which voltage oscillates and forms an oscillatory electric field, that is, an electrical field in which potential level alternates, and portions in which voltage does not oscillate, and therefore, forms an electrical field in which potential level remains constant (this development bias hereinafter will be referred to as "blank pulse bias"). In other words, in the development process, during the period corresponding to the oscillatory portion of the development bias, an alternating electric field is formed between the photosensitive drum and development roller, whereas during the period corresponding to the non-oscillatory portion of the development bias, a DC electric field (electric field with constant potency) is formed between the photosensitive drum and development roller. Otherwise, this embodiment is the same as the first embodiment; the basic structure of the image forming apparatus 100 in this embodiment is identical to that in the first embodiment.

To describe the blank pulse bias in more detail in terms of waveform, referring to FIG. 6, the blank pulse bias is such a bias that the portion A (pulsatory portion) with an ordinary rectangular waveform, and the portion B (blank portion) with no change in potential level, alternate. In terms of waveform, the blank pulse bias shown in FIG. 6 comprises the pulsatory portions P equivalent to 10 cycles of waveform, and the blank portions B, the duration of which is equivalent to 10 cycles of the waveform of each of the pulsatory portions P. Hereinafter, the blank pulse bias such as the one described above will be referred to as 10/10 BP (10 cycles of oscillation/interval with length equivalent is to 10 cycle of oscillation).

Also in this embodiment, the oscillatory electric field formed between the photosensitive drum 1 and development roller 11 is switched in magnitude, on the side which repels the toner T toward the photosensitive drum 1 (that is, toner supplying side of electric field), in accordance with the rotational speed, that is, peripheral velocity, of the photosensitive drum 1; the force which acts in the direction to move the toner T toward the photosensitive drum 1, is switched in accordance with the peripheral velocity of the photosensitive drum 1. More concretely, control is executed so that P/(P+B), wherein P (sec) stands for the duration of the oscillatory portion (pulsatory portion) of the blank pulse bias, and B (sec) stands for the duration of the non-oscillatory portion (blank portion) of the blank pulse bias, is varied in value, in accordance with the rotational speed, that is, peripheral velocity, of the photosensitive drum 1. More specifically, in this embodiment, (i) as the peripheral velocity of the photosensitive drum 1 is increased, P/(P+D) is increased in value; (ii) as the rotational speed of the photosensitive drum 1 is reduced, P/(P+B) is reduced in value. As the photosensitive drum 1 is changed in peripheral velocity, the development roller 11 is also changed in peripheral velocity, so that the ratio between the peripheral velocity of the photosensitive drum 1 and that of the development roller 11 will remain constant.

Figure 7:
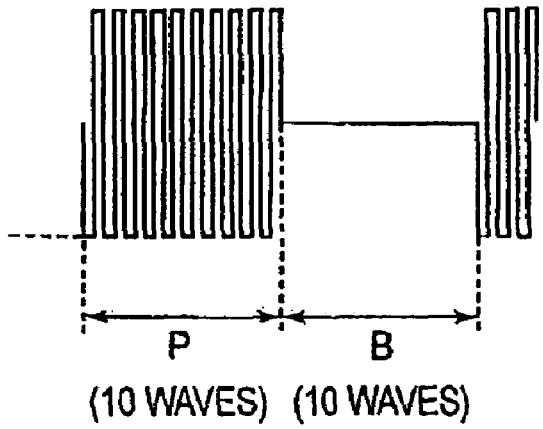
FIG. 7 is a schematic drawing depicting the changes in the waveform of the development bias in accordance with the present invention.
Figure 7:
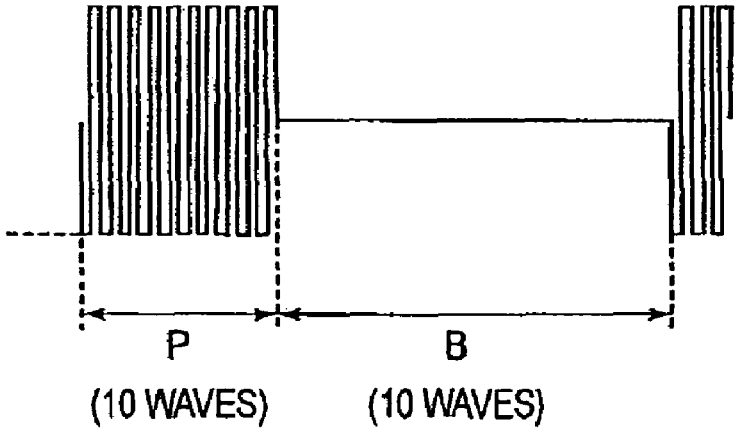
Figure 7:
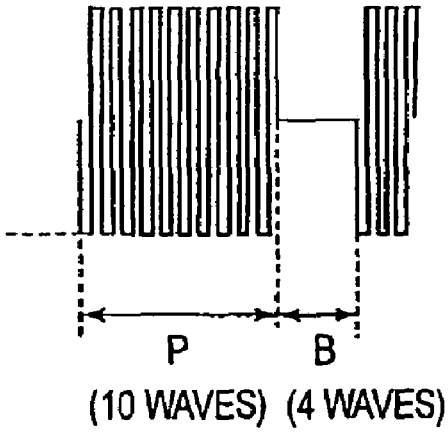

Table 2 shows the relationship between the rotational speed of the photosensitive drum 1 and the value to which the development bias is set. FIGS. 7(*a*)-7(*c*) show the waveforms (bias conditions (i)-(iii)) of the blank pulse biases, corresponding to the rotational speeds of the photosensitive drum 1.

In this embodiment, the development bias is −500 V in the dark potential level on the photosensitive drum 1, −100 V in light potential level, 3,000 Hz in AC voltage frequency (AC voltage frequency in oscillatory portion), 2,000 V in the peak-to-peak voltage of the AC voltage, −250 V in the DC voltage applied in combination with the AC voltage, and 50% in development duty.

TABLE 2

| DRUM SPEED (mm/sec) | BIAS | BLANK PLS |
|---|---|---|
| 50 | (i) | 10/10 BP |
| 25 | (ii) | 10/20 BP |
| 100 | (iii) | 10/4 BP |

Next, the method for evaluating the sweep-up phenomenon will be described.

Figure 8:
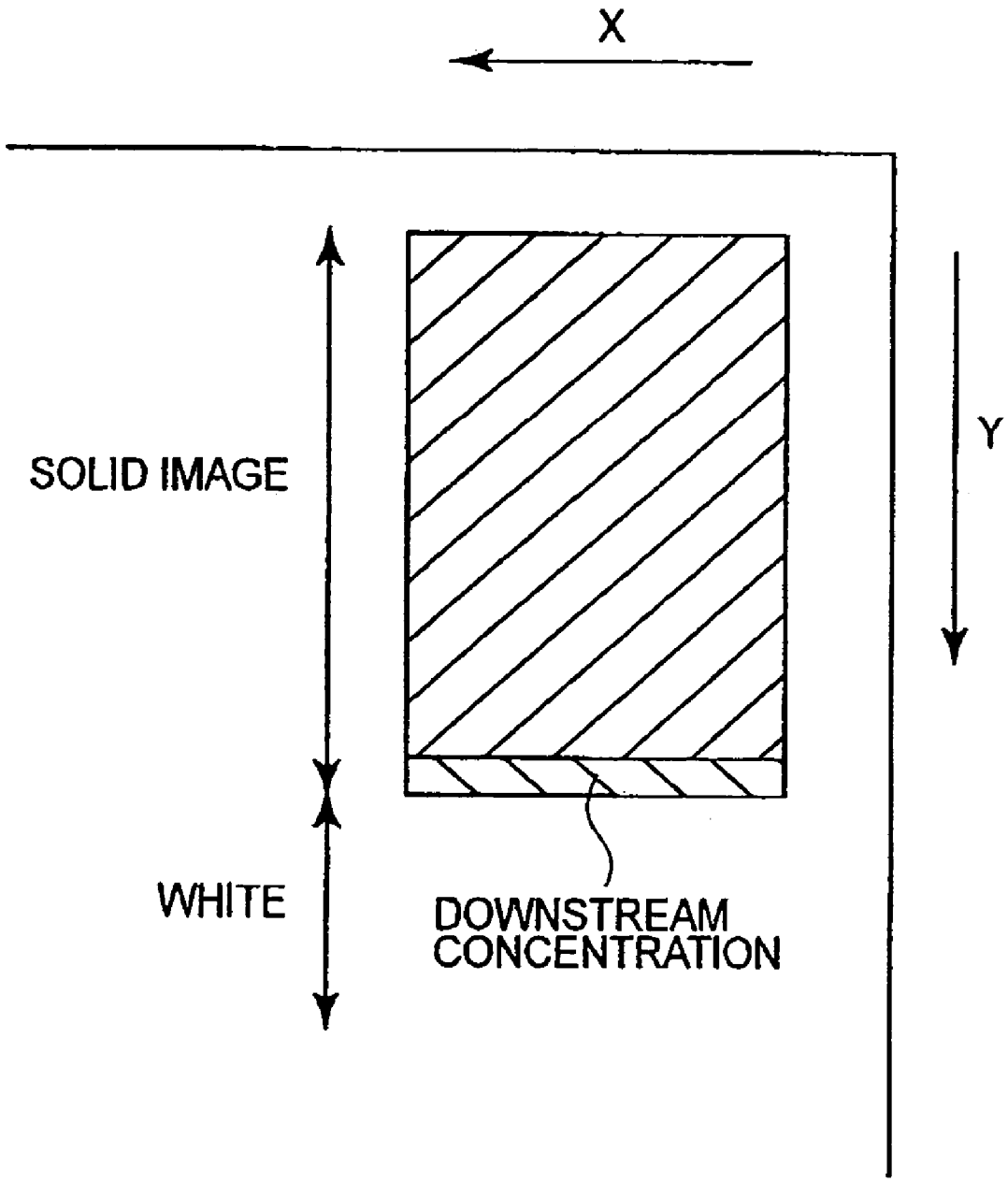
FIG. 8 is a schematic drawing depicting the sweep-up phenomenon.
Figure 9:
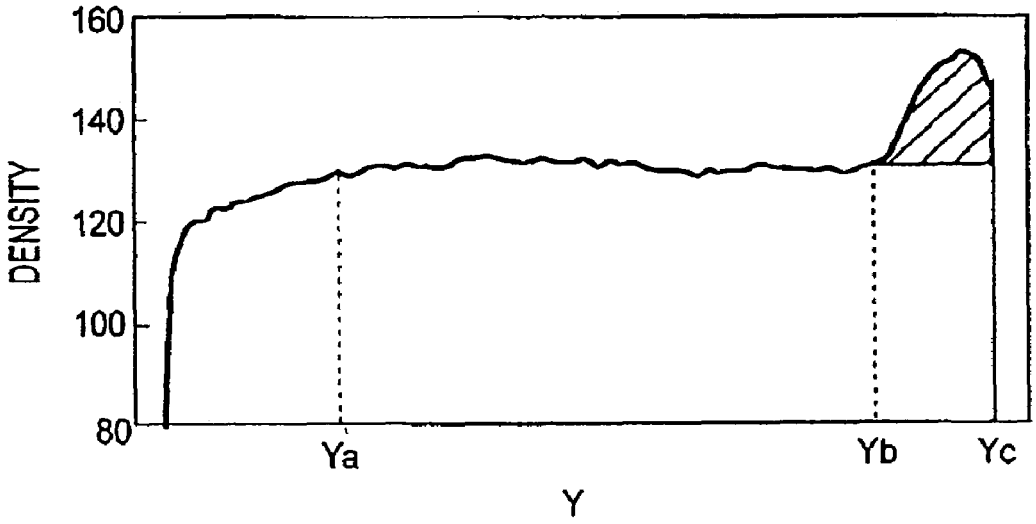
FIG. 9 is a graph describing the method of numerically expressing the sweep-up phenomenon.

The greater the difference in potential level between the exposed and unexposed portions on the photosensitive drum 1, the more conspicuous the sweep-up phenomenon. In other words, the sweep-up phenomenon is more conspicuous in an image in which an area solidly covered with developer (toner) adjoins a solid white area (area to which developer (toner) did not adhere). FIG. 8 is a part of an image pattern used for evaluating the effects of this embodiment. The pattern is an alternating repetition of a 30 mm×20 mm patch of solid color and a blank patch (solid white patch). This pattern is inputted into a personal computer with the use of an image scanning system, and the image density of a given point of the solid color area is converted into numerical values from 0 to 255. FIG. 9 is a graph showing the density distribution of the sample image, that is, the relationship between a given point on the Y axis of the same image in FIG. 8, and the density level thereof.

To describe the method for numerically expressing the severity of the sweep-up phenomenon, referring to FIG. 9, the range extending from Yb to Yc is greater in density than the range extending from Ya to Yb. In other words, the range extending from Yb to Yc is the range in which the sweep-up phenomenon has occurred. The size of the hatched portion in the graph in FIG. 9 is equivalent to the amount of the density increase attributable to the sweep-up phenomenon, and can be obtained by the integration of the density distribution between the Yb to Yc. In this embodiment, the density change per one millimeter is employed as the value representing the severity of the sweep-up phenomenon. In the case of the sweep-up phenomenon data in FIG. 9, the value of the sweep-up range Yb-Yc is 4 (mm), and the value (size of hatched area) obtained by the integration of the density across this range is 160 (dig). Therefore, the sweep-up value is 160/4=40 (dig/mm).

The above example is not intended to limit the scope of the present invention. However, according to the experiments carried out by the inventors of the present invention, when the sweep-up phenomenon index was no more than 20 (dig/mm), the sweep-up phenomenon was inconspicuous to the naked eye. Thus, an image with a sweep-up phenomenon index of no more than 20 was considered to be a satisfactory image.

In order to confirm the effects of this embodiment, the image forming apparatus in this embodiment, the development bias of which was varied based on Table 2 given above, was compared with the second comparative image forming apparatus, which is identical in structure (inclusive of developing apparatus 10) to that in this embodiment, except that the development bias of the second comparative image forming apparatus was kept constant even when the rotational speed of the photosensitive drum 1 was varied.

The development bias of the second comparative image forming apparatus was the same as the bias condition (i) in Table 2. In other words, it was 3,000 Hz in frequency, 2,000 V in peak-to-peak voltage $V_{pp}$ of the AC voltage, −250 V in the DC voltage $V_{dc}$, and 10/10 BP.

Figure 10:
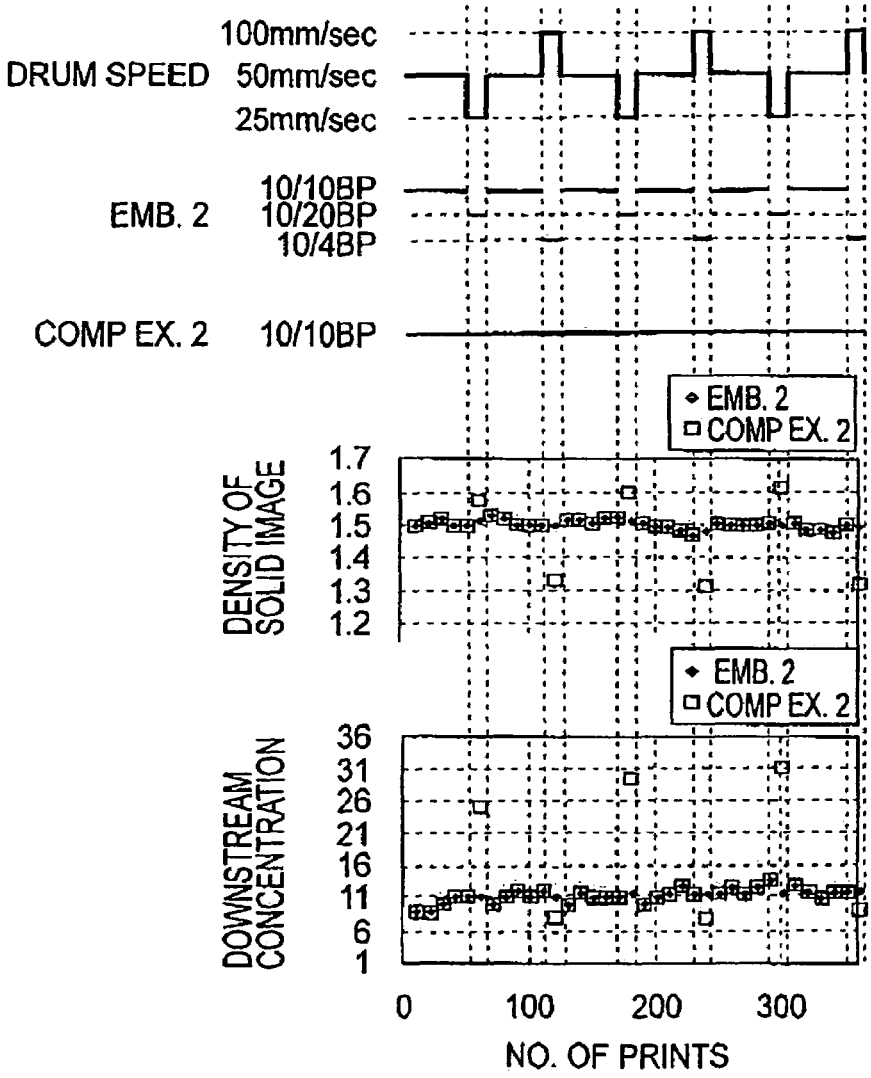
FIG. 10 is a graph showing the effects of the present invention.

In comparative tests, 50 copies were printed with the photosensitive drum 1 rotated at 50 mm/sec, and then, 10 copies were printed with the photosensitive drum 1 rotated at 25 mm/sec. Next, 50 copies were printed with the photosensitive drum 1 rotated at 50 mm/sec, and 10 copies were printed with the photosensitive drum 1 rotated at 100 mm/sec. In other words, after the printing of every 50 copies with the photosensitive drum 1 rotated at 50 mm/sec, the rotational speed of the photosensitive drum 1 was alternately switched to 25 mm/sec and 100 mm/sec, until a total of 360 copies were printed. Thereafter, the density of the portion of each printed image solidly covered with the toner T (maximum image density) was measured with the use of a commercially available reflection densitometer. Further, the sweep-up phenomenon indexes were calculated with the use of the method described above. FIG. 10 shows the timing chart, and the relationship between the density of the solidly toner covered portion (average density of every 10 copies) and the sweep-up phenomenon indexes.

As will be evident from FIG. 10, in the case of the second comparative example of an image forming apparatus, as the rotational speed of the photosensitive drum 1 was varied, the solid area density also changed, and also, the sweep-up phenomenon index worsened; the sweep-up phenomenon was exacerbated. In comparison, in the case of the image forming apparatus in this embodiment, even when the rotational speed of the photosensitive drum 1 was varied, the solid area density remained virtually stable, and the sweep-up phenomenon index remained in the satisfactory range.

The reason for the abovementioned results is thought to be as follows.

Figure 11:
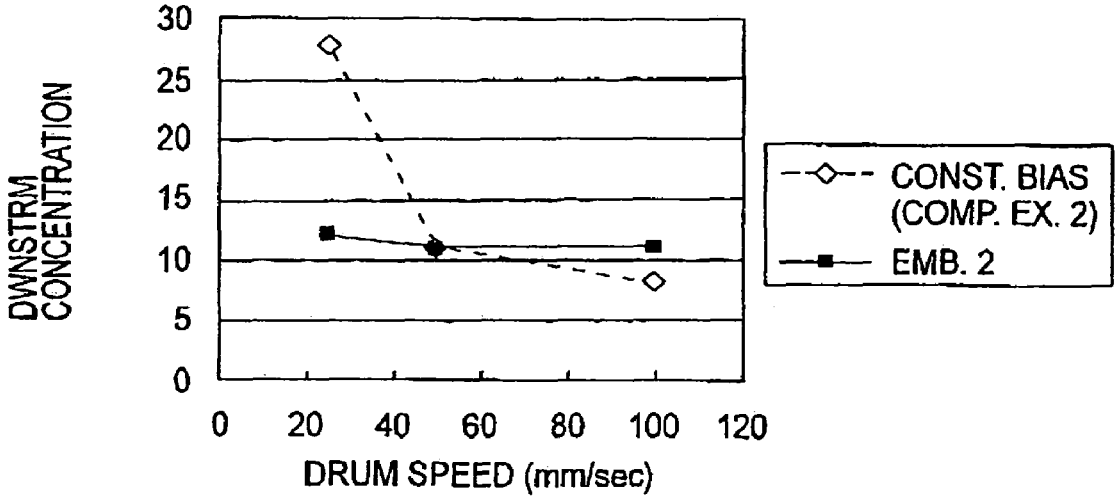
FIG. 11 is a graph showing the effects of the present invention.
Figure 12:
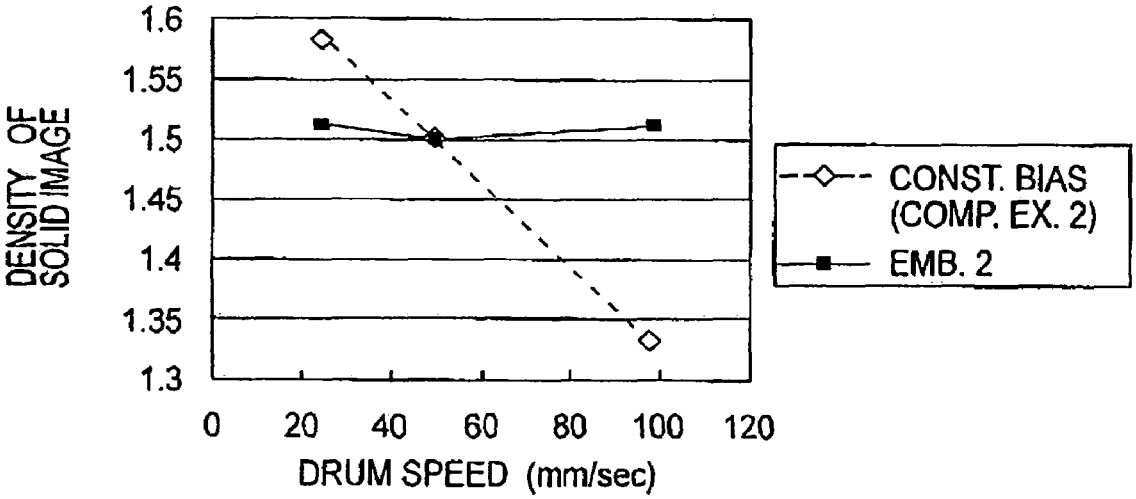
FIG. 12 is a graph showing the effects of the present invention.

FIG. 11 shows the changes which occurred to the severity of the sweep-up phenomenon as the speed of the photosensitive drum 1 was varied. FIG. 12 shows the changes which occurred to the solid area density as the rotational speed of the photosensitive drum 1 was varied. In each of the graphs in FIGS. 11 and 12, the broken line represents the test results of the second comparative image forming apparatus, the blank pulse bias (development bias) for which was kept constant at 10/10 BP, and the solid line represents the test results of the image forming apparatus in this embodiment, the blank pulse bias (development bias) for which was varied in response to the changes in the rotation speed of the photosensitive drum 1.

As shown in FIG. 11, in the case of the comparative image forming apparatus, as the rotational speed of the photosensitive drum 1 was reduced with the development bias kept constant, the sweep-up phenomenon worsened, exceeding the sweep-up phenomenon index of 20. As for the image density, as the rotational speed of the photosensitive drum 1 was reduced with the development bias kept constant, the image density increased, as shown in FIG. 12.

In comparison, in the case of the image forming apparatus in this embodiment, even when the rotational speed of the photosensitive drum 1 was varied, the sweep-up phenomenon index remained below 20, and also, the image density remained virtually constant. The reason for this effect is thought to be that the formation of an image suffering from the sweep-up phenomenon is attributable to the shuttling of the toner T between the photosensitive drum 1 and development roller 11. In other words, the greater the number of times the toner T shuttles, the more likely is the sweep-up phenomenon to be exacerbated. This is thought to be why the slower the rotational speed of the photosensitive drum 1, the more exacerbated the sweep-up phenomenon.

Generally, the toner T gains such momentum that causes the toner T to jump toward the photosensitive drum 1 or development roller 11, when the development bias switches in the direction in which it works. The blank pulse bias reduces the number of times the development bias switches in the direction in which it works, reducing thereby the number of times the toner T is made to shuttle between the photosensitive drum 1 and development roller 11. Therefore, the blank pulse bias is advantageous from the standpoint of minimizing the severity of the sweep-up phenomenon.

Further, the amount by which the number of times the toner T shuttles between the photosensitive drum 1 and development roller 11 is reduced by the usage of the blank pulse bias can be controlled by controlling the amplitude ratio of the blank pulse bias. The amplitude ratio is the value of a mathematical formula: P/(P+B)×100%, wherein P stands for the duration of the oscillatory (pulsatory) period of the electric field, and B stands for the length of time the electric field does not oscillate. In other words, the amplitude ratio is the ratio of the total length of time the electric field oscillates (pulsates) to the total length of time the development bias is applied.

As the amplitude ratio is increased, toner T is increased in the amount of shuttling movement, whereas as the amplitude ratio is decreased, the toner T is reduced in the amount of shuttling movement. Thus, as the rotational speed of the photosensitive drum 1 is reduced, the time available for development increases, and therefore, the amplitude ratio is to be reduced in accordance with the increase in the development time, in order to reduce the toner T in the shuttling movement. Further, as the photosensitive drum 1 is increased in rotation, the time available for development reduces, and therefore, it is permissible to leave the amplitude ratio unchanged; it is permissible to leave the toner T unchanged in the amount of shutting movement.

Further, as the amplitude ratio is increased, the length of time available for development increases, and the force which acts in the direction to move the toner T toward the photosensitive drum 1 also increases. On the other hand, as the amplitude ratio is decreased, the length of time available for development decreases, and the force which acts in the direction to move the toner T toward the photosensitive drum 1 also decreases.

Thus, in this embodiment, as the photosensitive drum 1 is increased in rotational speed, the blank pulse bias is increased in amplitude ratio, whereas as the photosensitive drum 1 is decreased in rotational speed, the blank pulse bias is decreased in amplitude ratio. Therefore, not only is the image forming apparatus kept constant in image density, but also, the sweep-up phenomenon is prevented from occurring.

Further, when the rotational speed of the photosensitive drum 1 is greater than a predetermined value, the blank portion may be eliminated from the development bias (blank pulse bias); the amplitude ratio may be 100%.

The blank pulse bias can be modified with the use of a circuit relative simple in structure. Further, this embodiment is very effective in that the usage of the blank pulse bias makes it easier to adjust the oscillatory electric field, on the side from which the toner T is caused to jump, in accordance with the rotational speed of the photosensitive drum 1 (there is roughly linear relationship).

Incidentally, in this embodiment, three blank pulse biases different in amplitude ratio (10/10 BP, 10/20 BP, and 10/4 BP) were used. However, the optimal amplitude ratio for the blank pulse bias is affected by various factors, for example, the SD gap, diameters of the photosensitive drum 1 and development roller 11, etc. Therefore, the effects of the present invention can be maximized by optimally setting the amplitude ratio of the blank pulse bias in accordance with the various factors which affect the operation of the image forming apparatus 100.

Further, in the case of an image forming apparatus structured so that the photosensitive drum 1 can be increased in peripheral velocity to a value higher than the highest of the abovementioned ones, the blank portion may be eliminated from the blank pulse bias; the development bias may have only the oscillatory (pulsatory) portion.

Further, the control may be such that when the peripheral velocity of the photosensitive drum 1 is no more than a predetermined value, the development bias is provided with intervals in which the electric field is not oscillated, whereas when the peripheral velocity of the photosensitive drum 1 is greater than the predetermined value, the development bias is not provided with the intervals in which the electric field is not oscillated, in other words, the duration of each interval, that is, the blank portion B, in which the electric field is not oscillated, may be set to zero.

In the case of this embodiment, in addition to varying the above described amplitude ratio, at least one among the peak-to-peak voltage $V_{pp}$ of the oscillatory portion of the development bias, voltage $V_{dc}$ of the DC bias applied in combination with the AC bias, development duty, and waveform of the AC, may be changed. Further, the frequency f may be changed.

Further, in this embodiment, the ratio in peripheral velocity between the photosensitive drum 1 and development roller 11 is kept constant by changing the peripheral velocity of the development roller 11 as the peripheral velocity of the photosensitive drum 1 is changed.

As will be evident from the above description of this embodiment, this embodiment prevents the occurrence of the sweep-up phenomenon, and also, the image forming apparatus from changing in image density, even when the photosensitive drum 1 is changed in rotational speed. Therefore, it can make it possible to always form high quality images.

Embodiment 3

Next, another embodiment, or the third embodiment, of the present invention will be described. The basic structure and operation of the image forming apparatus in this embodiment are virtually the same as those in the first embodiment. Thus, the components of the image forming apparatus in this embodiment, which are virtually identical or equivalent in structure and function to those in the first embodiment, are given the same referential symbols as those given for the description of the first embodiment, and will not be described in detail.

In this embodiment, the image forming apparatus is controlled in density by controlling the speed of the development roller 11. More specifically, the image forming apparatus 100 in this embodiment is enabled to operate in the low speed printing mode, standard mode, and high speed printing mode. In the low speed printing mode, the ratio of the peripheral velocity of the development roller 11 relative to that of the photosensitive drum 1 is reduced to reduce the image forming apparatus in image density, whereas in the high speed printing mode, the ratio of the peripheral velocity of the development roller 11 relative to that of the photosensitive drum 1 is increased to increase the image forming apparatus in image density. As for the peripheral velocity of the photosensitive drum 1, it is kept the same regardless of the operation mode. Otherwise, the image forming apparatus in this embodiment is identical in structure and operation to that in the second embodiment.

The control system of the image forming apparatus 100 in this embodiment is roughly the same as that shown in FIG. 2, except that the image forming apparatus 100 in this embodiment is provided with a development roller speed varying means (unshown), in the form of a driver circuit, connected to the power source (unshown) of the driving portion of the development roller 11 and enabled to varying the rotational speed of the development roller 11 in accordance with the type of the recording medium Q or external data. The development roller speed varying means varies the rotational speed of the development roller 11 in response to the signals which the controlling means 51 (CPU) of the control portion 50 generates based on the programs and data stored in the ROM 52.

In the high speed printing mode, the ratio of the peripheral velocity of the development roller 11 relative to that of the photosensitive drum 1 was increased, and therefore, the amount by which toner was offered for development was greater, and consequently, the image forming apparatus was higher in image density. This, however, sometimes resulted in the above described exacerbation of the sweep-up phenomenon.

In this embodiment, therefore, the oscillatory electric field formed between the photosensitive drum 1 and development roller 11 is switched in magnitude, on the side from which the toner T is moved toward the photosensitive drum 1, that is, the force which acts in the direction to move the toner T toward the photosensitive drum 1 is switched in magnitude. More specifically, in this embodiment, in order to switch in magnitude the electric field, on the side from which the toner T is made to jump, that is, the amount of the force which acts in the direction to move the toner T toward the photosensitive drum 1, (i) as the peripheral velocity of the photosensitive drum 1 is increased, P/(P+B) is increased in value; (ii) as the peripheral velocity of the photosensitive drum 1 is reduced, P/(P+B) is reduced in value, as in the second embodiment, wherein P stands for the duration of the oscillatory (pulsatory) period of the electric field, and B stands for the length of time the electric field does not oscillate.

Table 3 shows the relationship between the difference in peripheral velocity between the development roller 11 and photosensitive drum 1 (ratio of peripheral velocity of development roller 11 relative to that of photosensitive drum 1), and development bias.

In this embodiment, the photosensitive drum 1 was −500 V in dark potential level, and 100 V in light potential level. The development bias was 3,000 Hz in the frequency of the oscillatory portion (pulse portion) thereof, 2,000 V in the peak-to-peak voltage of the oscillatory portion, −250 V in the DC bias applied in combination with the AC bias, and 50% in development duty.

TABLE 3

| MODES | SPEED DIF. | BIAS | BLANK PLS |
|---|---|---|---|
| STD. | 150% | (a) | 10/10 BP |
| HIGH | 200% | (b) | 8/16 BP |
| LOW | 100% | (c) | 10/3 BP |

In this embodiment, the image forming apparatus is controlled so that when in the high speed printing mode, the blank pulse bias is adjusted in amplitude ratio to reduce the sweep-up phenomenon in severity while increasing the image density, whereas when in the low speed printing mode, the difference in peripheral velocity between the development roller 11 and photosensitive drum 1 is reduced, and also, the amplitude ratio of the blank pulse bias is adjusted, as shown in Table 3, to keep the image density at a predetermined level.

In order to confirm the effects of this embodiment, the image forming apparatus in this embodiment, the development bias of which was varied based on Table 3 given above, was compared with the third comparative image forming apparatus, which is identical in structure (inclusive of developing apparatus 10) to that in this embodiment, except that the development bias of the third comparative image forming apparatus was kept constant even when the difference in peripheral velocity between the development roller 11 and photosensitive drum 1 was varied.

The conditions of the development bias for the third comparative image forming apparatus were the same as the bias conditions (a) in Table 3. In other words, it was 3,000 Hz in frequency, 2,000 V in peak-to-peak voltage $V_{pp}$, −250 V in the DC voltage $V_{dc}$, and 10/10 BP in amplitude ratio.

In comparative tests, 50 copies were printed in the standard mode, and then, 10 copies were printed in the high speed printing mode. Next, 50 copies were printed in the standard printing mode, and 10 copies were printed in the low speed printing mode. In other words, after the printing of every 50 copies in the standard mode, the rotational speed of the photosensitive drum 1 was alternately switched to low speed and high speed; a printing cycle of stand mode—high speed printing mode—standard mode—low speed printing mode was repeated, until a total of 360 copies were printed. Thereafter, the density of the portion of each printed image solidly covered with the toner T (maximum image density) was measured with the use of a commercially available reflection densitometer. Further, the sweep-up phenomenon indexes were calculated with the use of the method described above.

Figure 13:
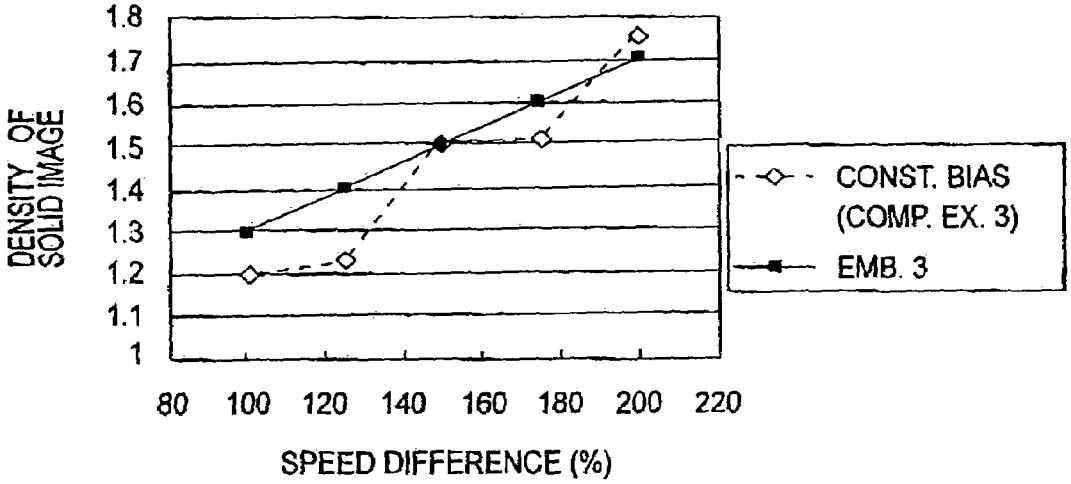
FIG. 13 is a graph showing the effects of the present invention.
Figure 14:
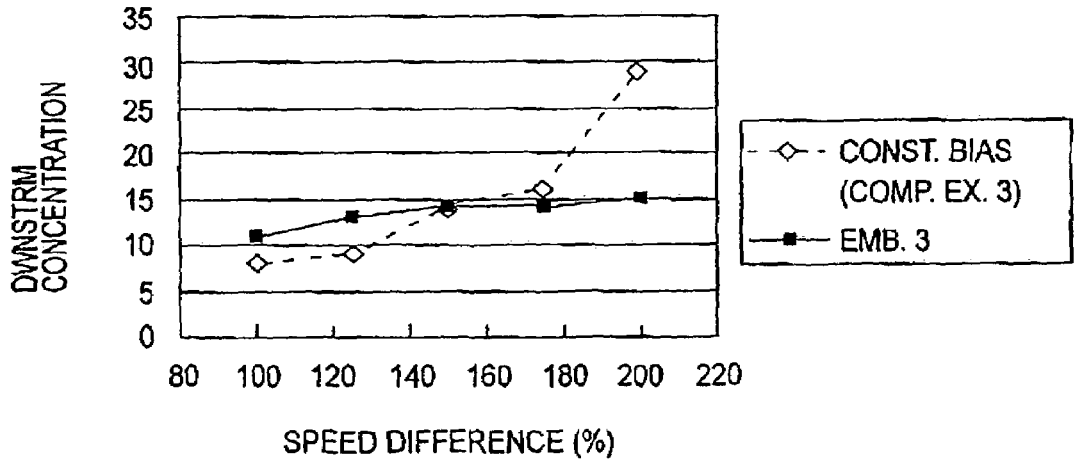
FIG. 14 is a graph showing the effects of the present invention.

FIG. 13 shows the changes in the image density resulting from the changes in the ratio (%) of the peripheral velocity of the development roller 11 relative to that of the photosensitive drum 1. FIG. 14 shows the changes in the severity of the sweep-up phenomenon resulting from the changes in the ratio (%) of the peripheral velocity of the development roller 11 relative to that of the photosensitive drum 1. In each of the graphs in FIGS. 13 and 14, the broken line represents the test results of the third comparative image forming apparatus, in which the amplitude ratio of the blank pulse bias was kept at 10/10 BP, and the solid line presents the test results of the image forming apparatus in this embodiment, in which the blank pulse bias was varied in amplitude ratio in accordance with the changes in the ratio (%) of the peripheral velocity of the development roller 11 relative to that of the photosensitive drum 1.

As will be evident from the graphs, when the development bias was not changed in spite of the changes in the printing mode, the change in the image density was not proportional to the changes in the printing mode (changing in printing speed); the amount of the change in density which occurred as the operational mode was switched from the standard mode to the high speed printing mode was different from that occurred when the operational mode was switched from the standard mode to the low speed printing mode. Further, the sweep-up phenomenon was exacerbated in the high speed printing mode.

In comparison, in the case of the apparatus in this embodiment, the amount of the change in image density which occurred when the operational mode was switched remained constant, and the sweep-up phenomenon did not substantially increase in severity.

Incidentally, in this embodiment, three blank pulse biases different in amplitude ratio (10/10 BP, 8/16 BP, and 10/3 BP) were used. As has been known, the optimal amplitude ratio for the blank pulse bias is affected by Various factors, for example, the SD gap, diameters of the photosensitive drum 1 and development roller 11, etc. Therefore, the effects of the present invention can be obtained by optimally setting the amplitude ratio of the blank pulse bias in accordance with the various factors which affect the operation of the image forming apparatus 100.

Further, in this embodiment, the amplitude ratio of the blank pulse bias was varied in accordance with the rotational speed of the development roller 11. However, instead of, or in addition to, varying the amplitude ratio of the blank pulse bias, at least one may be varied among the peak-to-peak voltage $V_{pp}$ of the oscillatory portion (pulse portion) of the development bias, voltage $V_{dc}$ of the DC bias applied in combination with the AC bias, development duty, and waveform of the AC. Further, the frequency f may be varied.

In the above, the present invention was concretely described with reference to the preferred embodiments of the present invention. However, the preceding embodiments were not intended to limit the scope of the present invention. Hereinafter, the miscellaneous aspects of the present invention will be described.

For simplification, the preceding embodiments were described with reference to the image forming operation in which a monochromatic image was formed by developing an electrostatic image with the use of one of the developing apparatuses containing yellow, magenta, cyan, and black toners, one for one. However, the present invention is also satisfactorily applicable to a color image forming apparatus capable of forming a color image with the use of a plurality of toners different in color. In the case of a color image forming apparatus, an image is formed by placing in layers a plurality of toner images, and therefore, the above described changes in image density and/or exacerbation of the sweep-up phenomenon is more likely to be conspicuous. In other words, the present invention is especially effective when applied to a color image forming apparatus.

As for the types of a color image forming apparatus to which the present invention is applicable, there are generally two types, that is, the direct transfer type and the indirect transfer type. In the case of the direct transfer type, a plurality of toner images are sequentially transferred onto recording medium borne on a recording medium bearing member as a developer image conveying member, as they are sequentially formed on a single image bearing member with the use of a plurality of developing means, and then, they are fixed to the recording medium; or a plurality of toner images are sequentially transferred onto recording medium borne on the recording medium, as they are sequentially formed on a plurality of image bearing members, one for one, with the use of a plurality of developing means, one for one, and then, they are fixed to the recording medium. In the case of the indirect type, a plurality of toner images are sequentially transferred in layers onto an intermediary transferring member as a developer image conveying member, as they are sequentially formed on a single or plurality of image bearing members, and then, they are transferred all at once from the intermediary transferring member onto the recording medium, and are fixed to the recording medium.

Figure 15:
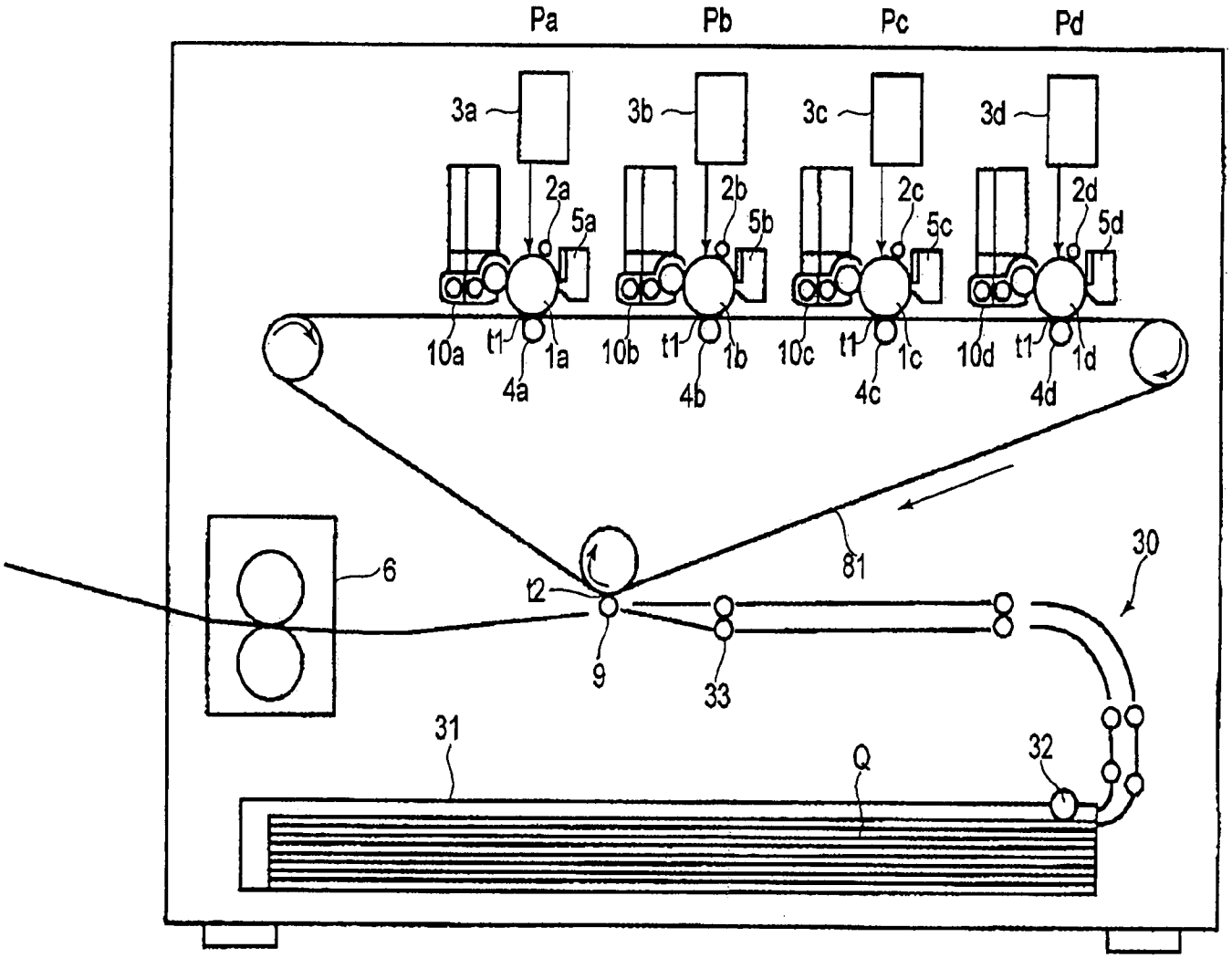
FIG. 15 is a schematic drawing of another example of an image forming apparatus to which the present invention is applicable, showing the general structure thereof.

For example, referring to FIG. 15, the image forming means of the image forming apparatus in this drawing comprises a plurality of photosensitive drums 1*a*, 1*b*, 1*c*, and 1*d* as image bearing members, and a plurality of image formation stations Pa, Pb, Pc, and Pd in which yellow, magenta, cyan, and black toner images are formed, respectively. In operation, the toner images formed on the photosensitive drums 1*a*, 1*b*, 1*c*, and 1*d* are sequentially transferred (primary transfer) in layers onto an intermediary transfer belt 81 as an intermediary transferring member by the function of a primary transfer roller 4 as a primary transferring means, in the corresponding primary transfer stations t1, and then, are transferred (secondary transfer) all at once from the intermediary transfer belt 81 onto a recording medium Q by the function of a secondary transfer roller 9 as a secondary transferring means, in a secondary transfer station t2. In FIG. 15, the components which are virtually identical or equivalent in function and structure to those of the image forming apparatus 100 in FIG. 1 are given the same referential symbols as those given to the counterparts in FIG. 1. Further, the components of each of the image formation stations Pa-Pd, which are identical or equivalent in function and structure to those in other image formation stations are given subscripts a-d, respectively, in addition to the letter P, in order to indicate their affiliation.

Figure 16:
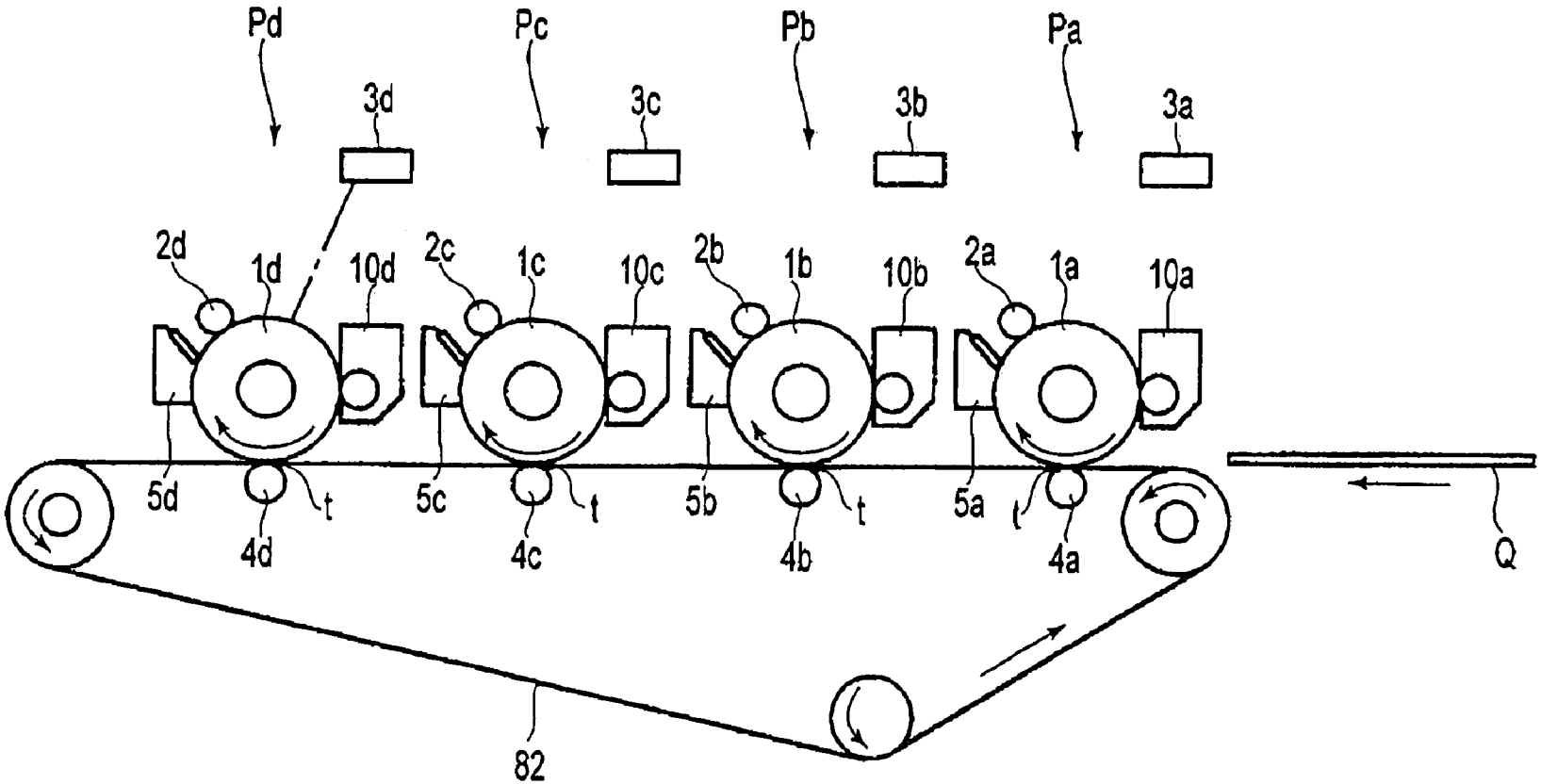
FIG. 16 is a schematic drawing of the essential portion of another example of an image forming apparatus to which the present invention is applicable, showing the general structure thereof.

FIG. 16 schematically shows the general structures of the essential portions of a color image forming apparatus having a recording medium bearing member in place of an intermediary transfer belt as a developer image conveying member. In the case of an image forming apparatus of this type, a copy is obtained by sequentially transferring in layers the toner images formed in the image formation stations Pa-Pd onto a recording medium Q borne on a recording medium bearing belt 82 as a recording medium bearing member, and fixing them to the recording medium Q. In FIG. 16, the components which are virtually identical or equivalent in function to those of the image forming apparatus in FIG. 1 or 15 are given the same referential symbols as those given to the counterparts in FIG. 1 or 15.

Figure 17:
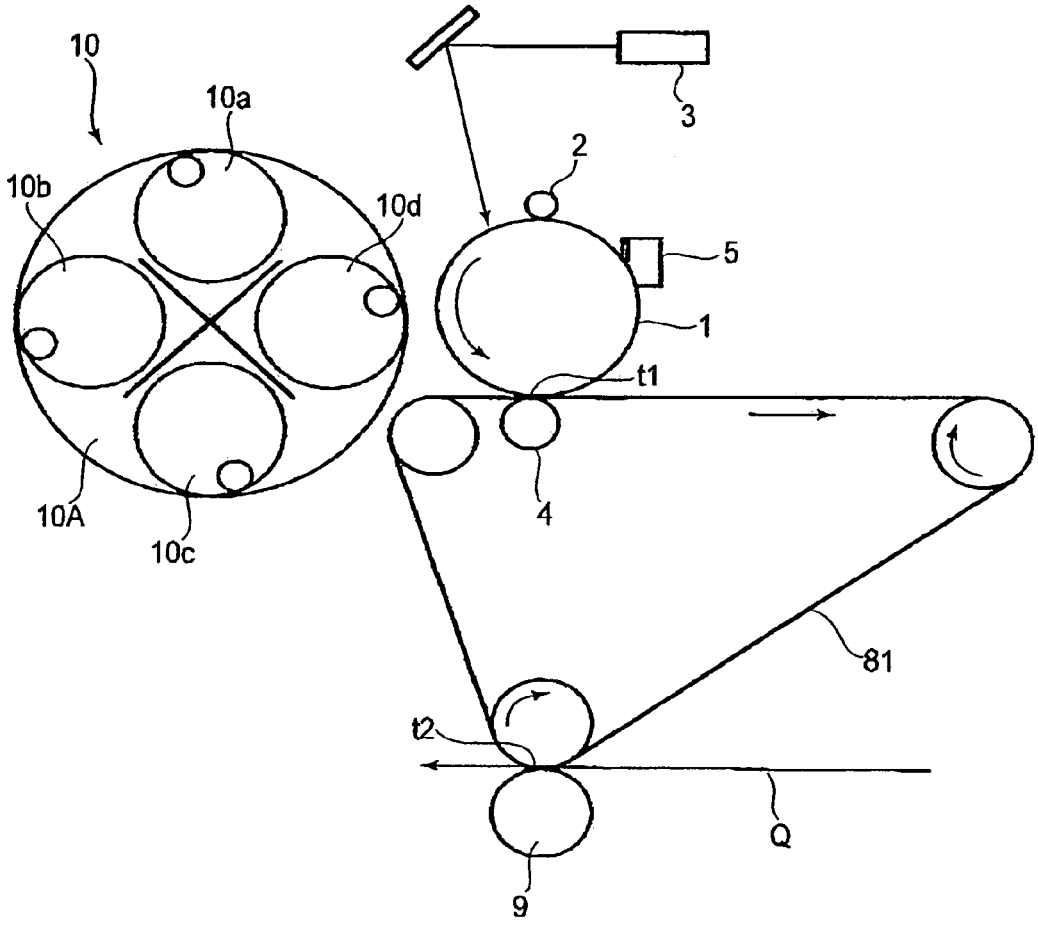
FIG. 17 is a schematic drawing of the essential portion of another example of an image forming apparatus to which the present invention is applicable, showing the general structure thereof.

FIG. 17 schematically shows the general structure of the essential portions of an example of an image forming apparatus which has a single image bearing member and a plurality of developing means, and in which in order to obtain a copy, a plurality of developer images are sequentially transferred onto a recording medium borne on a recording medium bearing member as they are formed on a single image bearing member; or a plurality of developer images are sequentially transferred (primary transfer) onto an intermediary transferring member as they are formed, and then, are transferred (secondary transfer) all at once onto the recording medium from the intermediary transferring member. The image forming apparatus in the drawing has a rotary developing apparatus 10, in the rotary 10A of which four developing apparatuses 10*a*, 10*b*, 10*c*, and 10*d* as developing means are mounted. By rotating the rotary 10A, a specific developing means can be placed in the position in which the developing means opposes the photosensitive drum 1 as an image bearing member, in order to sequentially form a plurality of toner images on the photosensitive drum 1. The toner images sequentially formed on the photosensitive drum 1 are transferred (primary transfer) onto an intermediary transfer belt 81 as an intermediary transferring member, in a primary transfer station t1, as they are formed. Then, they are transferred (secondary transfer) all at once onto a recording medium Q in the secondary transfer station t2. The components of the image forming apparatus in FIG. 17, which are practically identical or equivalent in function to those of the image forming apparatus in FIG. 1, 15, or 16 are given the same referential symbols as those given to the counterparts in FIG. 1, 15, or 16.

The present invention is equally applicable to the image forming apparatuses in FIGS. 15-17 as it is to the image forming apparatus in the first to third embodiments. That is, also in the case of these image forming apparatus in FIGS. 15-17, the same beneficial effects as those described above can be realized by controlling the development bias applied to each of the developing means as it was in the first to third embodiments.

According to the present invention, it is possible to prevent an image forming member from changing in image density, and sweep-up phenomenon from being exacerbated, even when the peripheral velocity of an image bearing member or a developer bearing member is varied. In other words, the present invention makes it possible to reliably form images of high quality even when an image bearing member or a developer bearing member is changed in peripheral velocity.

In all of the preceding embodiments, the AC voltage may be created by repeatedly turning on and off the output of the DC power source. Further, the voltage with the pulsatory waveform may be created by repeatedly turning on and off the DC power source.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 43548/2004 filed Feb. 19, 2004, which is hereby incorporated by reference.

What is claimed is:

1. An image forming apparatus comprising:

an image bearing member; and a developer carrying member, disposed opposed to said image bearing member, for carrying a developer, wherein an electric field is formed between said developer carrying member and said image bearing member during a developing operation using said developer carrying member, and the electric field includes an oscillating portion in which the electric field is an oscillating electric field, and wherein a supply electric field of said oscillating electric field which is effective to supply the developer to said image bearing member from said developer carrying member is variably controllable in accordance with a peripheral speed of said image bearing member.

2. An apparatus according to claim 1, wherein a peripheral speed of said developer carrying member changes when the peripheral speed of said image bearing member changes.

3. An apparatus according to claim 1, wherein said developer carrying member is supplied with a voltage comprising an AC component and a DC component to form the oscillating electric field, and wherein the change of the supply electric field is at least one of a change in a peak-to-peak voltage of the AC component, the DC component, a percentage of the voltage for forming the supply electric field and a waveform of the AC component.

4. An apparatus according to claim 3, wherein a frequency of the AC component is variably controlled.

5. An apparatus according to claim 1, wherein the electric field formed between said image bearing member and said developer carrying member during the developing operation includes the oscillating portion and a non-oscillating portion not forming the oscillating electric field, which appear alternately.

6. An apparatus according to claim 5, wherein P/(P+B) is variably controlled in accordance with a peripheral speed of said image bearing member, and wherein P is a time duration of said oscillating portion and B is a time duration of the non-oscillating portion.

7. An apparatus according to claim 6, wherein P/(P+B) increases with the peripheral speed of said image bearing member.

8. An apparatus according to claim 1, wherein the developer carried on said developer carrying member jumps to said image bearing member during the developing operation.

9. An apparatus according to any one of claims 1-8, wherein the developer is a non-magnetic one component developer.

10. An apparatus according to any one of claims 1-8, wherein the oscillating electric field is an alternating electric field formed between said image bearing member and said developer carrying member.

11. An image forming apparatus comprising:

an image bearing member; and a developer carrying member, disposed opposed to said image bearing member, for carrying a developer, wherein an electric field is formed between said developer carrying member and said image bearing member during a developing operation using said developer carrying member, and the electric field includes an oscillating portion in which the electric field is an oscillating electric field, and wherein a supply electric field of said oscillating electric field which is effective to supply the developer to said image bearing member from said developer carrying member is variably controllable in accordance with a peripheral speed of said developer carrying member.

12. An apparatus according to claim 11, wherein a peripheral speed difference between a peripheral speed of said image bearing member and the peripheral speed of said developer carrying member changes when the peripheral speed of said developer carrying member changes.

13. An apparatus according to claim 11, wherein said developer carrying member is supplied with a voltage comprising an AC component and a DC component to form the oscillating electric field, and wherein the change of the supply electric field is at least one of a change in a peak-to-peak voltage of the AC component, the DC component, a percentage of the voltage for forming the supply electric field and a waveform of the AC component.

14. An apparatus according to claim 13, wherein a frequency of the AC component is variably controlled in accordance with a peripheral speed of said developer carrying member.

15. An apparatus according to claim 11, wherein the electric field formed between said image bearing member and said developer carrying member during the developing operation includes the oscillating portion and a non-oscillating portion not forming the oscillating electric field, which appear alternately.

16. An apparatus according to claim 15, wherein P/(P+B) is variably controlled in accordance with a peripheral speed of said developer carrying member, and wherein P is a time duration of said oscillating portion and B is a time duration of the non-oscillating portion.

17. An apparatus according to claim 16, wherein P/(P+B) increases with the peripheral speed of said developer carrying member.

18. An apparatus according to claim 11, wherein the developer carried on said developer carrying member jumps to said image bearing member during the developing operation.

19. An apparatus according to any one of claims 11-18, wherein the developer is a non-magnetic one component developer.

20. An apparatus according to any one of claims 11-18, wherein the oscillating electric field is an alternating electric field formed between said image bearing member and said developer carrying member.

21. An image forming apparatus comprising:

an image bearing member; and a developer carrying member, disposed opposed to said image bearing member, for carrying a developer, wherein an electric field is formed between said developer carrying member and said image bearing member during a developing operation using said developer carrying member, and the electric field includes an oscillating portion in which the electric field is an oscillating electric field, and a non-oscillating portion in which the electric field is a non-oscillating electric field, which appear alternately, and wherein a percentage of a time duration of the oscillating portion during the developing operation is variably controlled in accordance with a peripheral speed of the image bearing member.

22. An apparatus according to claim 21, wherein a peripheral speed of said developer carrying member changes when the peripheral speed of said image bearing member changes.

23. An apparatus according to claim 21, wherein said developer carrying member is supplied with a voltage comprising an AC component and a DC component to form the oscillating electric field, and wherein the change of the supply electric field is at least one of a change in a peak-to-peak voltage of the AC component, the DC component, a percentage of the voltage for forming the supply electric field and a waveform of the AC component.

24. An apparatus according to claim 23, wherein a frequency of the AC component is variably controlled.

25. An apparatus according to claim 21, wherein P/(P+B) is variably controlled in accordance with a peripheral speed of said image bearing member, and wherein P is a time duration of said oscillating portion and B is a time duration of the non-oscillating portion.

26. An apparatus according to claim 25, wherein P/(P+B) increases with the peripheral speed of said image bearing member.

27. An apparatus according to claim 21, wherein a time duration of the non-oscillating portion is zero when the peripheral speed of said image bearing member is larger than a predetermined value.

28. An apparatus according to claim 21, wherein the developer carried on said developer carrying member jumps to said image bearing member during the developing operation.

29. An apparatus according to any one of claims 21-28, wherein the developer is a non-magnetic one component developer.

30. An apparatus according to any one of claims 21-28, wherein the oscillating electric field is an alternating electric field formed between said image bearing member and said developer carrying member.

* * * * *

UNITED STATES PATENT AND TRADEMARK OFFICE

CERTIFICATE OF CORRECTION

PATENT NO. : 7,254,350 B2
APPLICATION NO. : 11/060654
DATED : August 7, 2007
INVENTOR(S) : Takeshi Kawamura et al.

It is certified that error appears in the above-identified patent and that said Letters Patent is hereby corrected as shown below:

COLUMN 2:
Line 32, “described” should read --describe--.

COLUMN 3:
Line 55, “above described” should read --above-described--.

COLUMN 4:
Line 3, “above described” should read --above-described--;
Line 50, close up the right margin;
Line 50, close up the left margin;
Line 59, “adhered” should read --adhere--; and
Line 63, “above” should read --above- --.

COLUMN 5:
Line 9, “above described” should read --above-described--.

COLUMN 7:
Line 67, “above described” should read --above-described--.

COLUMN 12:
Line 67, “above described” should read --above-described--.

COLUMN 13:
Line 9, “above mentioned” should read --above-mentioned--; and
Line 54, “toner covered” should read --toner-covered--.

COLUMN 19:
Line 44, “relative” should read --relatively--.

COLUMN 20:
Line 10, “above described” should read --above-described--.

UNITED STATES PATENT AND TRADEMARK OFFICE

CERTIFICATE OF CORRECTION

PATENT NO. : 7,254,350 B2
APPLICATION NO. : 11/060654
DATED : August 7, 2007
INVENTOR(S) : Takeshi Kawamura et al.

It is certified that error appears in the above-identified patent and that said Letters Patent is hereby corrected as shown below:

COLUMN 21:
Line 11, "above described" should read --above-described--.

COLUMN 22:
Line 61, "Various" should read --various--.

COLUMN 23:
Line 26, "above" should read --above- --.

Signed and Sealed this

Thirteenth Day of May, 2008

JON W. DUDAS
*Director of the United States Patent and Trademark Office*